US008353572B2

(12) United States Patent
Kanbe et al.

(10) Patent No.: US 8,353,572 B2
(45) Date of Patent: Jan. 15, 2013

(54) INK SUPPLY DEVICES

(75) Inventors: Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 320 days.

(21) Appl. No.: 12/732,186

(22) Filed: Mar. 25, 2010

(65) Prior Publication Data

US 2010/0245459 A1 Sep. 30, 2010

(30) Foreign Application Priority Data

Mar. 27, 2009 (JP) ..... 2009-080585

(51) Int. Cl.
*B41J 29/393* (2006.01)
*B41J 2/175* (2006.01)

(52) U.S. Cl. ..... 347/19; 347/86

(58) Field of Classification Search ..... 347/19, 347/86
See application file for complete search history.

(56) References Cited

U.S. PATENT DOCUMENTS 8,002,380 B2 * 8/2011 Kondo ..... 347/19
2008/0180498 A1 7/2008 Hattori et al.
2010/0245458 A1 * 9/2010 Nakamura ..... 347/19

FOREIGN PATENT DOCUMENTS

JP 2008-246999 A 10/2008

* cited by examiner

*Primary Examiner* — Julian Huffman
(74) *Attorney, Agent, or Firm* — Baker Botts L.L.P.

(57) ABSTRACT

An ink supply device includes a cartridge mounting portion to which an ink cartridge is configured to be mounted by being inserted thereinto in an insertion direction, a first determiner configured to determine a first characteristic of the ink cartridge, and a second determiner configured to determine a second characteristic of the ink cartridge.

13 Claims, 10 Drawing Sheets

INK SUPPLY DEVICES

CROSS REFERENCE TO RELATED APPLICATION

This application claims priority to and the benefit of Japanese Patent Application No. 2009-080585, which was filed on Mar. 27, 2009, the disclosure of which is incorporated herein by reference in its entirety.

BACKGROUND OF THE INVENTION

The present invention relates to ink supply devices comprising a cartridge mounting portion to which an ink cartridge is configured to be mounted.

DESCRIPTION OF RELATED ART

A known inkjet recording apparatus (hereinafter referred to as "recording apparatuses") is configured to record an image on a recording sheet with ink. Such a recording apparatus has an inkjet recording head, and the recording head is configured to selectively eject ink, which is supplied to the recording head, onto a recording sheet through nozzles. Thus, an image is recorded on the recording sheet. The recording apparatus has a cartridge mounting portion configured to hold an ink cartridge therein. The ink cartridge is configured to be inserted into the cartridge mounting portion through an opening of the cartridge mounting portion. The ink cartridge comprises an ink supply portion configured to supply ink from the interior of the ink cartridge to the exterior of the ink cartridge. When the ink cartridge is inserted into and mounted to the cartridge mounting portion, the ink supply portion is opened, and the ink cartridge is ready to supply ink to the recording head.

A controller of another known recording apparatus, such as an apparatus described in JP-2008-246999, is configured to determine the type of the ink cartridge inserted into the cartridge mounting portion based on output signals of a plurality of optical detectors positioned in the cartridge mounting portion. This controller is configured to determine the type of the ink cartridge according to whether the level of the output signal of the optical detector detecting the detection target portion of the ink cartridge is greater than or equal to a predetermined value at a time at which a predetermined trigger signal is output.

SUMMARY OF THE INVENTION

A need has arisen for ink supply devices which overcome shortcomings of the related art. A technical advantage of the present invention is that a characteristic of an ink cartridge can be accurately determined when the ink cartridge is inserted into and mounted to the cartridge mounting portion.

According to an embodiment of the present invention, an ink supply device comprises a cartridge mounting portion to which an ink cartridge is configured to be mounted by being inserted thereinto in an insertion direction, a first optical detector comprising a first light emitter configured to emit light and a first light receiver configured to receive light emitted by the first light emitter, a second optical detector comprising a second light emitter configured to emit light and a second light receiver configured to receive light emitted by the second light emitter, a first output unit configured to output a reference signal when the ink cartridge reaches a predetermined position in the cartridge mounting portion, a first detection target portion positioned on the ink cartridge, the first detection target portion being configured to be positioned in a first optical path when the ink cartridge reaches the predetermined position, the first optical path extending from the first light emitter to the first light receiver, a first determiner configured to determine a first characteristic of the ink cartridge inserted into the cartridge mounting portion based on whether or not an intensity of light received by the first light receiver is greater than or equal to a predetermined value when the first output unit outputs the reference signal, a second output unit configured to output a mount completion signal when the ink cartridge reaches a mount position which is offset from the predetermined position in the insertion direction in the cartridge mounting portion, the mount completion signal indicating that the ink cartridge has been completely mounted to the cartridge mounting portion, a second detection target portion positioned on the ink cartridge, the second detection target portion being configured to be positioned in a second optical path when the ink cartridge reaches the mount position, the second optical path extending from the second light emitter to the second light receiver, and a second determiner configured to determine a second characteristic of the ink cartridge inserted into the cartridge mounting portion based on whether or not an intensity of light received by the second light receiver is greater than or equal to a predetermined value when the second output unit outputs the mount completion signal.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-10(A), like numerals being used for like corresponding parts in the various drawings.

Figure 1:
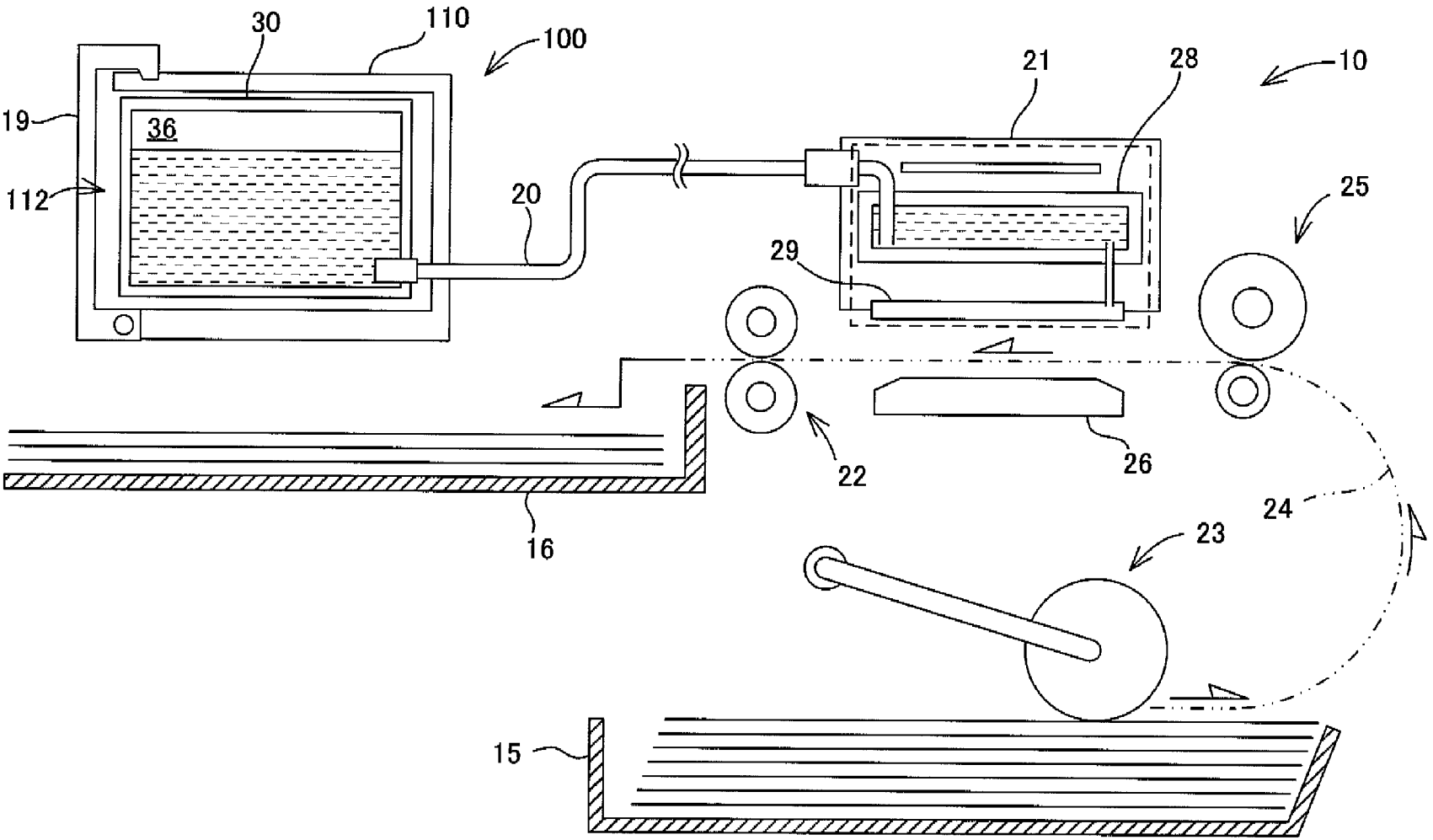
FIG. 1 is a schematic cross-sectional view of an internal structure of a printer according to an embodiment of the present invention.

Referring to FIG. 1, a printer 10 is configured to record an image by selectively ejecting ink droplets onto a recording sheet by using an inkjet printing method. As illustrated in FIG. 1, the printer 10 comprises an ink supply device 100. The ink supply device 100 comprises a cartridge holder 110 as an example of a cartridge mounting portion. The cartridge holder 110 is configured to accommodate four ink cartridges 30. A cover 19 is pivotally supported on the cartridge holder 110 at a lower end of an opening 112, such that the cover 19 can be opened and closed. The cover 19 is configured to pivot about the lower end portion of the opening 112, whereby the position of the cover 19 is changed between an open position in which the opening 112 is exposed and a closed position in which the opening 112 is covered by the cover 19. The ink cartridges 30 are inserted into the cartridge holder 110 through the opening 112 horizontally.

Each of the ink cartridges 30 is configured to store ink that can be used in the printer 10. More specifically, cyan, magenta, yellow, and black inks are stored in the ink cartridges 30 corresponding to respective colors. The ink cartridge 30 is configured to be in fluid communication with a recording head 21 through an ink tube 20. The recording head 21 comprises a sub-tank 28 configured to temporarily store ink. The recording head 21 is configured to selectively eject ink stored in the sub-tank 28 from nozzles 29 by using the inkjet printing method. When the ink is ejected, the pressure in the sub-tank 28 becomes less than the pressure in an ink chamber 36 of the ink cartridge 30. Thus, the ink is supplied from the ink cartridge 30 to the sub-tank 28 of the recording head 21 through the ink tube 20.

A sheet feed roller 23 is configured to feed a recording sheet from a first tray 15 to a transport path 24, and a pair of transport rollers 25 is configured to transport the recording sheet onto a platen 26. The recording head 21 is configured to eject ink onto the recording sheet passing over the platen 26. Thus, an image is printed on the recording sheet. A pair of discharge rollers 22 is configured to discharge the recording sheet, which has passed over the platen 26, onto a second tray 16 positioned at a downstream end of the transport path 24.

For the ink cartridge 30 storing ink of the same color, there are two types of ink cartridges 30 (30A and 30B) storing different initial amounts of ink. Examples of the types comprise a standard type for general users and a large volume type for heavy users who consume a large amount of ink. The initial amount of ink stored in a large volume type cartridge is greater than the initial amount of ink stored in a standard type cartridge. In this embodiment, the ink cartridge 30A is of the standard type, and the ink cartridge 30B is of the large volume type.

A pigment-based ink (pigment ink) or a dye-based ink (dye ink) may be used. Ink-ejection control of the recording head 21 differs depending on the coloring agent of the ink, that is, depending on whether the ink is pigment-based or dye-based. In this embodiment, for convenience of description, it is assumed that the ink cartridge 30A of the standard type stores a pigment-based ink and the ink cartridge 30B of the large-volume type stores a dye-based ink.

In the following description, the ink cartridges 30A and 30B will be collectively referred to as the ink cartridge 30, unless otherwise noted.

In the ink supply device 100, the ink cartridges 30A and 30B can be selectively inserted into and mounted to an accommodation space of the cartridge case 110. The characteristics of the ink cartridge 30 inserted into and mounted to the cartridge holder 110 are determined by a controller 90. The characteristics of the ink cartridge 30 comprise the initial amount of ink stored in the ink cartridge 30 and the coloring agent of ink stored in the ink cartridge 30. As described above, the initial amount of ink may be the standard amount or large amount, and the coloring agent of ink may be pigment or dye. More specifically, it is determined whether the ink cartridge 30 inserted into and mounted to the cartridge holder 110 is the standard type or the large volume type. Moreover, it is determined whether the ink stored in the ink cartridge 30 is a pigment-based ink or a dye-based ink.

Referring to FIGS. 2(A)-3(B), the ink cartridge 30B differs from the ink cartridge 30A in the shapes of a determination portion 86 and a protruding member 76 described below. In other respects, the ink cartridges 30A and 30B are the same. The difference between the ink cartridges 30A and 30B will be described later.

Figure 2A:
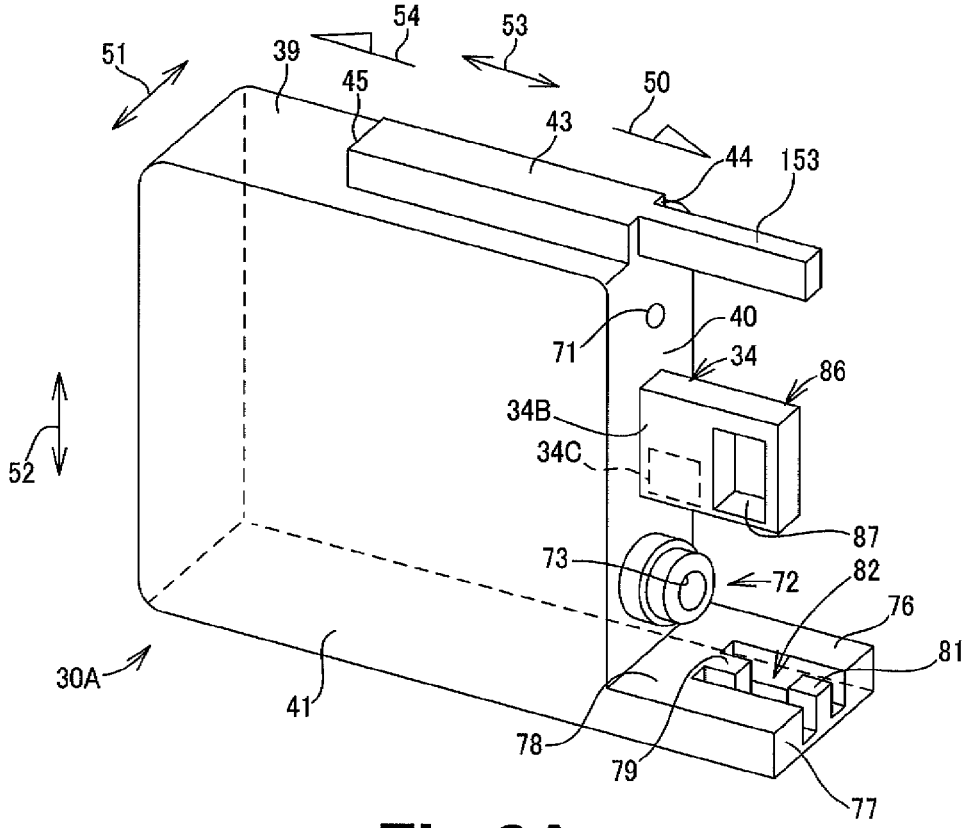
FIG. 2(A) is a perspective view of one type of an ink cartridge according to an embodiment of the present invention.
Figure 2B:
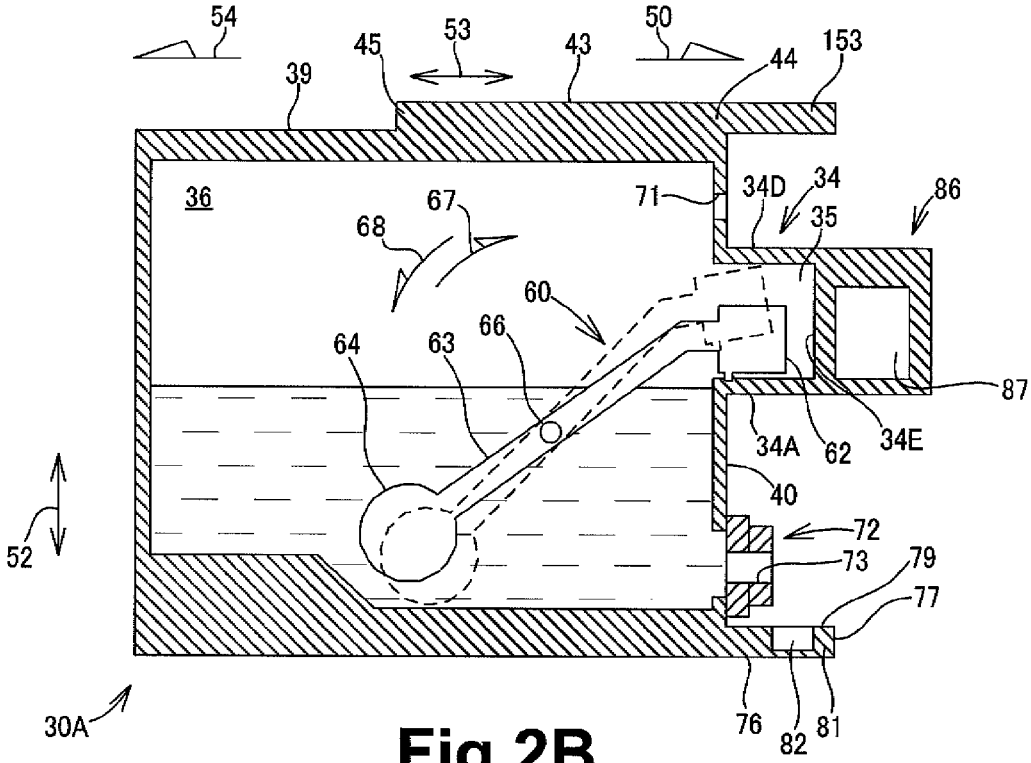
FIG. 2(B) is a vertical cross-sectional view of the ink cartridge.

Referring to FIGS. 2(A)-2(B), the ink cartridge 30A comprises the ink chamber 36 formed therein, and the ink chamber 36 is configured to store ink therein. The ink cartridge 30A is inserted into the cartridge holder 110 in an upright position illustrated in FIG. 2(A), that is, in such a manner that the lower surface of the ink cartridge 30A in FIG. 2(A) faces downward and the upper surface of the ink cartridge 30A in FIG. 2(A) faces upward. The ink cartridge 30A is inserted into the cartridge holder 110 in a direction indicated by an arrow 50 (hereinafter referred to as an "insertion direction 50"). When the ink cartridge 30A is mounted to the cartridge holder 110, the ink cartridge 30A is in the upright position.

The ink cartridge 30A has substantially a rectangular-parallelepiped shape. More specifically, the ink cartridge 30A has a flat shape that has dimensions in the width direction 51, in the height direction 52, and in the depth direction 53, and each of the dimensions in the height direction 52 and in the depth direction 53 is greater than the dimension in the width direction 51. The ink cartridge 30A is made of, for example, a translucent resin, e.g., transparent or semi-transparent resin through which light can pass. A rib 43 is positioned on an upper wall 39 of the ink cartridge 30A. An air communication opening 71, an ink supply portion 72, a protrusion 153, a protruding member 76, an ink amount detection portion 34, and the determination portion 86 are positioned at a front wall 40 of the ink cartridge 30A facing forward in the insertion direction 50 during insertion of the ink cartridge 30A into the cartridge holder 110.

Referring to FIG. 2(B), the ink amount detection portion 34 has substantially a rectangular-parallelepiped shape. The ink amount detection portion 34 protrudes outward (to the right side in FIG. 2(B)) from a middle portion of the front wall 40 with respect to the height direction 52. The ink amount detection portion 34 comprises an inner space 35 formed therein, and the inner space 35 is in fluid communication with the ink chamber 36. The inner space 35 is surrounded by a bottom wall 34A, side walls 34B, an upper wall 34D, and a front wall 34E of the ink amount detection portion 34. A light-blocking plate 62 of a detection arm 60, which will be described below, is inserted into the inner space 35.

The ink amount detection portion 34 is used for visually or optically detecting the amount of ink stored in the ink chamber 36. For this purpose, the ink amount detection portion 34 is formed of a translucent, e.g., transparent or semi-transparent material through which light, e.g., visible light or infrared light can pass. Thus, a user can look into the inner space 35 in the ink amount detection portion 34 from the outside of the ink amount detection portion 34. The distance between the side walls 34B, which is the width of the ink amount detection portion 34 in the width direction 51, is less than the width of the front wall 40 in the width direction 51. More specifically, the ink amount detection portion 34 has the width that allows the ink amount detection portion 34 to enter a detection area 115 of an optical detector 114 described below.

The detection arm 60 is positioned in the ink chamber 36. With the detection arm 60, the amount of ink stored in the ink chamber 36 can be detected from the outside of the ink cartridge 30A through the ink amount detection portion 34. The detection arm 60, which is made of a synthetic resin, comprises an arm body 63, the light-blocking plate 62, and a float 64.

The arm body 63 is pivotally supported by a supporting shaft 66 that is supported by the side walls 41 of the ink cartridge 30A. Thus, the detection arm 60 can pivot in the ink cartridge 30A in the directions of arrows 67 and 68.

The float 64 is positioned at an end of the arm body 63. The float 64 has, for example, a hollow formed therein, such that the float 64 can float on liquid, e.g., ink. Therefore, the float 64 moves up and down when the amount of ink stored in the ink chamber 36 increases and decreases. Thus, the detection arm 60 pivots according the movement of the float 64. Instead of providing the float 64 with a hollow formed therein, the entirety or a portion of a portion of the detection arm 60 from the supporting shaft 66 to the float 64 may be made of a material having a specific gravity less than the specific gravity of ink.

The light-blocking plate 62 is positioned at an end of the arm body 63 opposite the float 64. When the detection arm 60 pivots clockwise (in the direction of the arrow 67) in FIG. 2(B), the light-blocking plate 62 moves downward in the inner space 35. Then, the light-blocking plate 62 contacts the bottom wall 34A of the ink amount detection portion 34 and remains in a lower position (a position in which the light-blocking plate 62 contacts the bottom wall 34A of the ink amount detection portion 34, which is illustrated with a solid line in FIG. 2(B)). On the other hand, when the detection arm 60 pivots counterclockwise (in the direction of the arrow 68) in FIG. 2(B), the light-blocking plate 62 moves upward and away from the bottom wall 34A. Then, the light-blocking plate 62 contacts the upper wall 34D and remains in an upper position (a position in which the light-blocking plate 62 is positioned above and away from the bottom wall 34A and contacts the upper wall 34D, which is illustrated with a broken line in FIG. 2(B)). In FIG. 2(B), the position in which the light-blocking plate 62 contacts the bottom wall 34A is illustrated with the solid line, and the position in which the light-blocking plate 62 is away from the bottom wall 34A is illustrated with the broken line.

When the light-blocking plate 62 is in the lower position, the light-blocking plate 62 is aligned in the width direction 51 with an irradiation portion 34C positioned in a lower portion of the side walls 34B. That is, the light-blocking plate 62 and the irradiation portion 34C overlap each other in the width direction 51. On the other hand, when the light-blocking plate 62 is in the upper position, the light-blocking plate 62 is positioned above the irradiation portion 34C and is not aligned with the irradiation portion 34C in the width direction 31. That is, in the upper position, the light-blocking plate 62 and the irradiation portion 34C do not overlap each other in the width direction 51.

In this embodiment, when the amount of ink stored in the ink chamber 36 is greater than or equal to a predetermined amount, the buoyancy acts on the float 64, such that the detection arm 60 pivots in the direction of the arrow 67. Thus, the light-blocking plate 62 is moved toward the lower position and remains in the lower position. On the other hand, when the amount of ink stored in the ink chamber 36 is less than the predetermined amount, the gravity acts on the float 64, such that the detection arm 60 pivots in the direction of the arrow 68. Thus, the light-blocking plate 62 is moved toward the upper position and remains in the upper position. In this manner, the light-blocking plate 62 moves up and down in accordance with the amount of ink stored in the ink chamber 36, such that light, e.g., visible light or infrared light, from the optical detector 114 (described below) is blocked by the light-blocking plate 62 or is allowed to pass across the ink amount detection portion 34 in the width direction 51.

When the ink cartridge 30A is in a mount position in the cartridge holder 110, in which the ink cartridge 30 A is allowed to supply ink to the ink tube 20 via the cartridge holder 110, a light emitter of the optical detector 114 described below (see FIG. 4) emits light toward the irradiation portion 34C of the ink amount detection portion 34. When this occurs, if the light-blocking plate 62 is in the lower position (the position illustrated with the solid line in FIG. 2(B)), light is blocked by the light-blocking plate 62 in the inner space 35. On the other hand, if the light-blocking plate 62 is in the upper position (the position illustrated with the broken line in FIG. 2(B)), the light is not blocked by the light-blocking plate 62, and the light passes across the inner space 35 and reaches a light receiver of the optical detector 114. Therefore, whether the amount of ink stored in the ink chamber 36 is greater than the predetermined amount can be determined by analyzing the signal output from the optical detector 114.

The determination portion 86 is integrally formed with the ink amount detection portion 34, and positioned at the front of the ink amount detection portion 34 in the insertion direction 50.

The determination portion 86 has a rectangular parallelepiped shape having the same width as the ink amount detection portion 34. i.e., the width of the determination portion 86 is less than the width of the front wall 40 in the width direction 51. The determination portion 86 can enter the detection area 115 of the optical detector 114 (see FIG. 4) described below. The determination portion 86 comprises a window 87 formed there through in the width direction 51, such that light can pass through the window 87 in the width direction 51. Except for the window 87, the determination portion 86 is formed of a material that does allow light to pass there through. The determination portion 86 of the ink cartridge 30B, which will be described below, does not have the window 87.

The determination portion 86 is configured, such that at a time at which the protrusion 153 of the ink cartridge 30A is initially detected in a detection area 124 of an optical detector 123, the light emitted from the light emitter of the optical detector 114 passes through the window 87 and reaches the light receiver of the optical detector 114, thereby the intensity of light received by the light receiver of the optical detector 114 becomes greater than or equal to a predetermined value. As illustrated in FIG. 2(B), the window 87 is formed through the determination portion 86 of the ink cartridge 30A in the width direction 51. The window 87 is positioned at the same height as the irradiation portion 34C of the ink amount detection portion 34. During the insertion of the ink cartridge 30A into the cartridge holder 110, the window 87 enters the detection area 115 of the optical detector 114. If the intensity of light received by the light receiver of the optical detector 114 is greater than or equal to the predetermined value, the output signal of the optical detector 114 is a HI level signal. If the intensity of light received by the light receiver of the optical detector 114 is less than the predetermined value, the output signal of the optical detector 114 is a LOW level signal.

The air communication opening 71 is formed through the front wall 40 at a position above the ink amount detection portion 34. The ink chamber 36 communicates with the exterior of the ink cartridge 30A, i.e., with the atmosphere, through the air communication opening 71, such that air can be introduced into the ink chamber 36. The pressure in the ink chamber 36 is maintained at the atmospheric pressure, because the ink chamber 36 communicates with the atmosphere through the air communication opening 71.

The ink supply portion 72 is positioned at the front wall 40 below the ink amount detection portion 34. The ink supply portion 72 comprises an elastic annular member and protrudes outward (in the insertion direction 50) from the front wall 40. A through hole 73 is formed through a center portion of the ink supply portion 72. Ink is supplied from the ink chamber 36 to the exterior of the ink cartridge 30A through the through hole 73.

The ink cartridge 30A comprises the rib 43 extending in the depth direction 53. The rib 43 comprises two side walls extending upward from the upper wall 39 of the ink cartridge 30A and an upper wall connecting top sides of the side walls to each other. The width of the side walls of the rib 43 is less than the width of the upper wall 39 in the width direction 51. An end portion 44 of the rib 43 corresponds to an upper end of the front wall 40. An end portion 45 opposite the end portion 44 (on a rear side with respect to the insertion direction 50) is positioned in about the middle of the upper wall 39 with respect to the depth direction 53. When the ink cartridge 30A is mounted to the cartridge holder 110 in the mount position, a lock lever 145 described below contacts the end portion 45 of the rib 43.

The ink cartridge 30A comprises the protruding member 76. The protruding member 76 extends from the lower end of the front wall 40 when the ink cartridge 30A is in the upright position illustrated in FIG. 2(A). More specifically, the protruding member 76, which is formed of a material that blocks light, is positioned at the front wall 40 below the ink supply portion 72. The protruding member 76 protrudes outward (in the insertion direction 50) from the front wall 40 further than the ink supply portion 72. In this embodiment, the width of the protruding member 76 is the same as the width of the of the front wall 40 in the width direction 51. That is, the length of the protruding member 76 in the insertion direction 50 (the distance between the front wall 40 and an end surface 77 of the protruding member 76 in the insertion direction 50) is greater than that of the length of the ink supply portion 72 in the insertion direction 50 (the distance between the front wall 40 and the end of the ink supply portion 72 in the insertion direction). Therefore, even if the ink cartridge 30A is dropped with the front wall 40 facing downwards and contacts a surface, the impact of the contact is applied to the protruding member 76. Because the impact is not directly applied to the ink supply portion 72, the ink supply portion 72 is protected from the impact.

The protruding member 76 comprises a rib 79 extending in the depth direction 53 of the ink cartridge 30A. The rib 79 is configured to be detected by an optical detector 126 described below. The rib 79 is made by forming two grooves 80, which extend parallel to each other in the depth direction 53, in an upper surface 78 of the protruding member 76. As with the protruding member 76, the rib 79 is made of a material that blocks light. The grooves 80 are open in the insertion direction 50 at the end surface 77 of the protruding member 76 in the insertion direction 50. The rib 79 has a width (dimension in the width direction 51) that allows the rib 79 to enter a detection area 127 of the optical detector 126 described below. The grooves 80 have widths (dimensions in the width direction 51) that allow the light emitter and the light receiver of the optical detector 126 to be inserted thereinto from the end surface 77 side. During the insertion of the ink cartridge 30A into the cartridge holder 110 toward the mount position, the light emitter and the light receiver enter the grooves 80 and the rib 79 enters the optical path extending in the detection area 127.

The rib 79 has a cutout 82 formed therein. The cutout 82 is positioned at a position separated from the end surface 77 of the rib 79 by a predetermined distance toward the front wall 40 in a removal direction 54 opposite the insertion direction 50. A light-blocking portion 81 of the rib 70 is positioned at the front of the cutout 82 in the insertion direction 50. The light-blocking portion 81 is configured to block light. During the insertion of the ink cartridge 30A into the cartridge holder 110 toward the mount position, the light-blocking portion 81 moves across the detection area 127 so as to block light directed toward the light receiver of the optical detector 126 in the detection area 127. When the light-blocking portion 81 moves across the detection area 127, the light is blocked. The cutout 82 is configured to be positioned in the detection area 127 of the optical detector 126 when the ink cartridge 30A is in the mount position. Therefore, when the ink cartridge 30A reaches the mount position, light emitted by the light emitter of the optical detector 126 passes through the cutout 82 and reaches the light receiver of the optical detector 126 without being blocked by the rib 79. That is, when the ink cartridge 30A is in the mount position, the cutout 82 allows the light traveling toward the light receiver of the optical detector 126 to pass there through.

In another embodiment, instead of the cutout 82, a member configured to allow light to pass there through, such as glass or a transparent resin plate may be used.

The protrusion 153 protrudes from the end portion 44 of the rib 43 in the insertion direction 50. That is, the protrusion 153 protrudes in the insertion direction 50 from the upper end of the front wall 40. The length of the protrusion 153 is the same as the length of the protruding member 76 in the insertion direction 50, and the protrusion 153 protrudes further than the ink supply portion 72 in the insertion direction 50. The protrusion 153 is positioned above the ink supply portion 72. The ink supply portion 72 is positioned between the protrusion 153 and the protruding member 76.

The protrusion 153 is configured to be detected by the optical detector 123 described below. The protrusion 153 is made of a material that blocks light. The width of the protrusion 153 is less than the width of the rib 43 in the width direction 51. More specifically, the protrusion 153 extends from the end portion 44 of the rib 43 in the insertion direction 50, and has a width that allows the protrusion 153 to enter the detection area 124 of the optical detector 123. During the insertion of the ink cartridge 30A into the cartridge holder 110 toward the mount position, the protrusion 153 enters the optical path in the detection area 124 and blocks light.

Figure 3A:
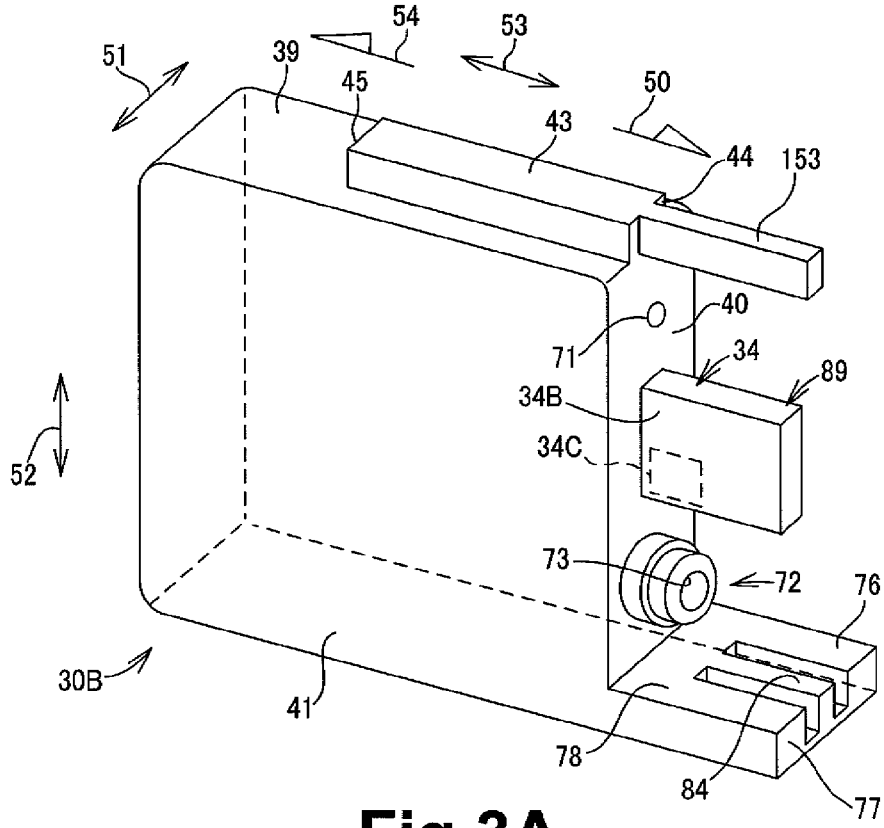
FIG. 3(A) is a perspective view of another type of an ink cartridge according to an embodiment of the present invention.
Figure 3B:
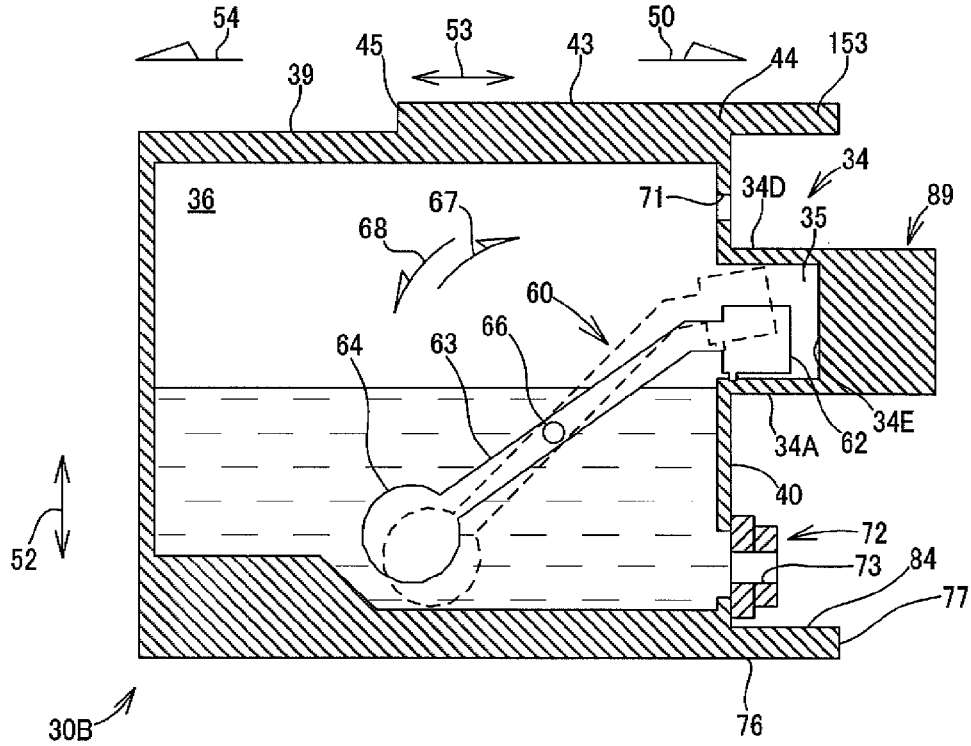
FIG. 3(B) is a vertical cross-sectional view of the ink cartridge.

Referring to FIGS. 3(A) and 3(B), the ink cartridge 30B comprises the protruding member 76 comprising a rib 84 that does not have the cutout 82, and the determination portion 89 that does not have the window 87 positioned in front of the ink amount detection portion 34 in the insertion direction 50. In this embodiment, the rib 84 that does not have the cutout 82 is used for the ink cartridge 30B that stores dye-based ink. The determination portion 89 that does not have the window 87 is used for the ink cartridge 30B of the large-volume type. The components excluding the rib 84 and the determination portion 89 are common to those of the ink cartridge 30A. Therefore, the components of the ink cartridge 30B that are common to the ink cartridge 30A will be denoted by the same numerals and the description of such components will be omitted.

Because the rib 84 and the determination portion 89 are provided, during insertion of the ink cartridge 30B in to the cartridge holder 110 toward the mount position, the rib 84 passes through the detection area 127 and blocks light emitted by the light emitter of the optical detector 126 toward the light receiver of the optical detector 126. When the ink cartridge 30B is mounted in the mount orientation, the rib 84 is positioned in the detection area 127, so that the rib 84 blocks light emitted by the light emitter of the optical detector 126 toward the light emitter of the optical detector 126. The determination portion 89 blocks light that passes through the detection area 115 toward the light receiver of the optical detector 114. When the ink cartridge 30B is mounted in the mount position, the determination portion 89 is positioned in the detection area 115, such that the determination portion 89 blocks light emitted by the light emitter of the optical detector 114 toward the light emitter of the optical detector 114.

Figure 4A:
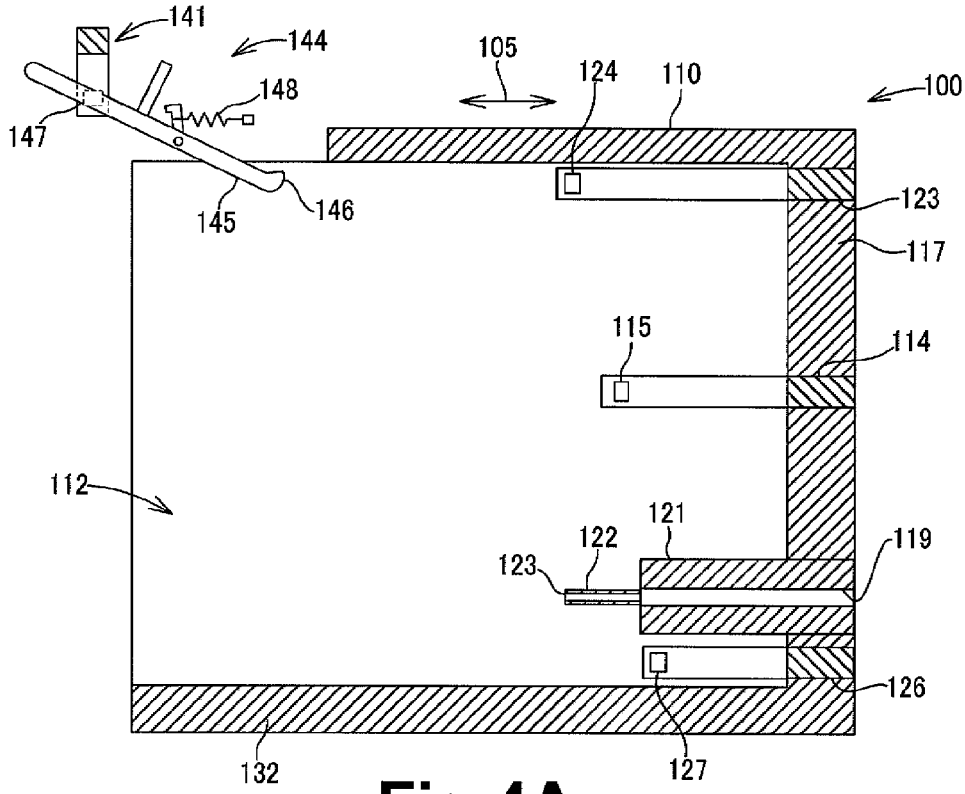
FIGS. 4(A) and 4(B) are vertical cross-sectional views of a cartridge holder according to an embodiment of the present invention, in which a lock lever is in a lock position in FIG. 4(A) and in an unlock position in FIG. 4(B).
Figure 4B:
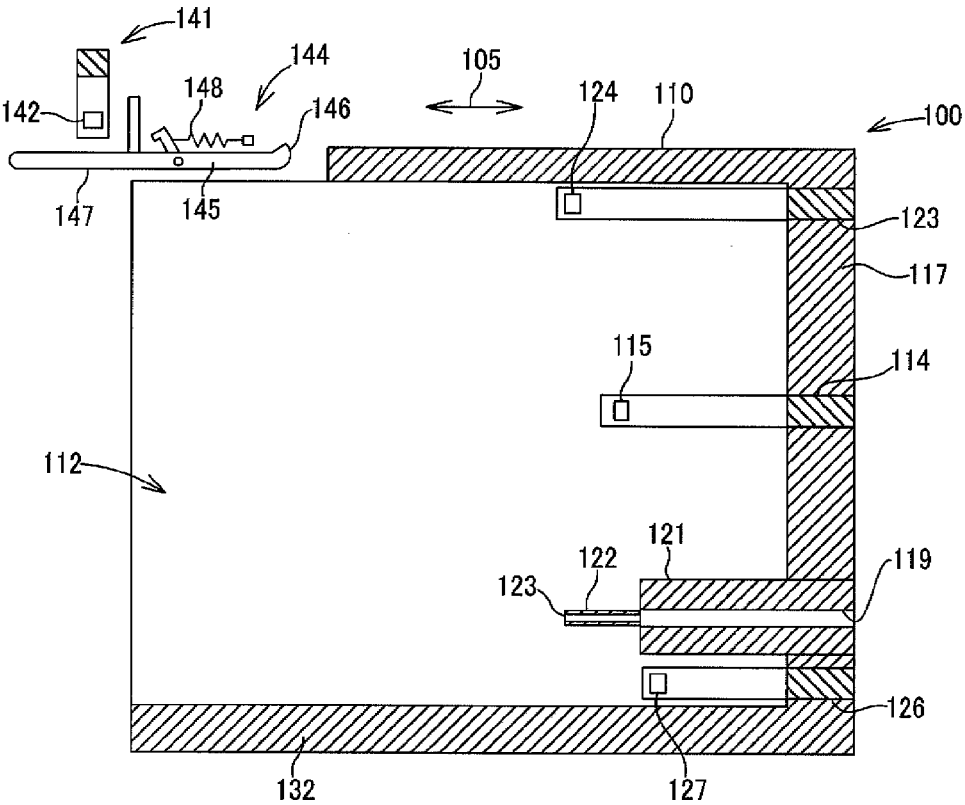

Referring to FIGS. 4(A) and 4(B), the ink supply device 100 is configured to supply ink to the recording head 21 (see FIG. 1) of the printer 10. The ink supply device 100 comprises the cartridge holder 110 to which four ink cartridges 30 can be mounted. The ink cartridge 30 is configured to be held in the cartridge holder 110. The cartridge holder 110 comprises the opening 112 formed there through, and the ink cartridge 30 is inserted into the cartridge holder 110 through the opening 112 horizontally.

A connection portion 121, which is to be connected to the ink supply portion 72, is positioned at a lower portion of an end wall 117 positioned opposite the opening 112, and an opening 119 is formed through the connection portion 121 and extends up to the exterior of the cartridge holder 110. The ink supply tube 122 having a cylindrical shape is attached to the connection portion 121. The ink supply tube 122 protrudes from the connection portion 121 toward the opening 112, that is, in a removal direction 54 opposite the insertion direction 50. The interior of the ink supply tube 122 is contiguous with the opening 119. The ink tube 20 (see FIG. 1) is connected to the exterior side of the opening 119. When the ink cartridge 30 is mounted to the cartridge holder 110 in the mount position, the ink supply portion 72 is connected to the connection portion 121. Thus, the ink supply tube 122 is inserted into the through hole 73 in the ink supply portion 72, and an ink path extending from the ink chamber 36 to the ink tube 20 via the through hole 73, the ink supply tube 122, and the opening 119 is formed.

The optical detector 114 is positioned at a middle portion of the end wall 117 of the cartridge holder 110 with respect to the height direction 52. The optical detector 114 is configured to detect the determination portion 86, 89, such that the controller 90 can determine a characteristic of the ink cartridge 30, e.g., determine the initial amount of ink stored in the ink cartridge 30, e.g., determine whether the ink cartridge 30 is the standard type ink cartridge 30A or the large volume type ink cartridge 30B. The optical detector 114 is also configured to detect the ink amount detection portion 34 of the ink cartridge 30 and the light-blocking plate 62 positioned in the ink amount detection portion 34, such that the controller 90 can determine the actual amount of ink stored in the ink cartridge 30. The optical detector 114 comprises a light emitter and a light receiver. The light emitter, such as a light emitting diode, can emit light such as visible light or infrared light. The light receiver, such as a phototransistor, can receive the light emitted by the light emitter. The light emitter and the light receiver are disposed in a substantially U-shaped resin case so as to face each other in the horizontal direction. In this embodiment, a light-transmission-detecting-type detector is used as the optical detector 114. In another embodiment, instead of the optical detector 114, a light-reflection-detecting-type detector can be used.

The optical detector 114 is electrically connected to the controller 90, and an electric signal output from the light receiver of the optical detector 114 is input to the controller 90. The level of the output signal corresponds to the intensity of light received by the light receiver. In this embodiment, when the ink cartridge 30 reaches a predetermined position before reaching the mount position in the cartridge holder 110, the determination portion 86, 89 enter the detection area 115 of the optical detector 114, which is an optical path extending from the light emitter to the light receiver of the optical detector 114, such that the determination portion 86, 89 is positioned in the optical path in the detection area 115. When the ink cartridge 30 reaches the mount position, the irradiation portion 34C of the ink amount detection portion 34 enters the detection area 115, and is positioned in the optical path of the detection area 115. In this embodiment, the controller 90 is configured to determine whether the ink cartridge 30 is of the standard type or the large-volume type based on the output signal of the optical detector 114 when the determination portion 86 or the determination portion 89 enters the detection area 115. The controller 90 determines whether the remaining amount of ink has become less than the predetermined amount based on the output signal of the optical detector 114 when the ink amount detection portion 34 is in the detection area 115.

The optical detector 126 is positioned at a lower portion of the end wall 117 of the cartridge holder 110. The optical detector 126 is positioned corresponding to the rib 79, 84 of the ink cartridge 30. The optical detector 126 is configured to detect the rib 79, 84, such that the controller 90 can determine a characteristic of the ink cartridge 30, e.g., determine the coloring agent of ink stored in the ink cartridge 30, e.g., determine whether the ink cartridge 30 is the ink cartridge 30A storing the pigment ink or the ink cartridge 30B storing the dye ink. As illustrated in FIGS. 4(A) and 4(B), the optical detector 126 has the same structure as the optical detector 114. The optical detector 126 comprises a light emitter and a light receiver. The light emitter can emit light such as visible light or infrared light. In this embodiment, a light-transmission-detecting-type detector is used as the optical detector 126. In another embodiment, instead of the optical detector 126, a light-reflection-detecting-type detector can be used.

The optical detector 126 is electrically connected to the controller 90. The light receiver of the optical detector 126 outputs an electric signal, and the output signal is input to the controller 90. When the rib 79 or the rib 84 enters the detection area 127 of the optical detector 126, which is an optical path extending from the light emitter to the light receiver, light emitted by the light emitter is blocked, and the output signal of the light receiver, corresponding to the intensity of light received by the light receiver, of the optical detector 126 changes.

An optical detector 123, which has the same structure as the optical detectors 114 and 126, is positioned in an upper portion of the end wall 117 of the cartridge holder 110. The optical detector 123 is positioned corresponding to the protrusion 153 of the ink cartridge 30. The optical detector 123 is electrically connected to the controller 90. The light receiver of the optical detector 123 outputs an electric signal, and the output signal is input to the controller 90. When the protrusion 153 enters the detection area 124 of the optical detector 123, which is an optical path extending from the light emitter to the light receiver, light emitted by the light emitter is blocked, and the output signal of the light receiver, corresponding to the intensity of light received by the light receiver, of the optical detector 123 changes.

The cartridge holder 110 comprises a lock mechanism 144. When the ink cartridge 30 is in the mount position, the lock mechanism 144 prevents the movement of the ink cartridge 30 in the removal direction 54 opposite the insertion direction 50, and fix (lock) the ink cartridge 30 in the mount position. The lock mechanism 144 is positioned on a side of the cartridge holder 110 opposite the side on which the optical detector 126 is positioned. In other words, the optical detector 126 and the lock mechanism 144 are positioned on a diagonal line of the vertical cross-section of the cartridge holder 110 at positions opposite each other. To be specific, the lock mechanism 144 is positioned above the opening 112.

The lock mechanism 144 comprises the lock lever 145 and a coil spring 148 configured to apply an urging force to the lock lever 145. The lock lever 145 is pivotally supported and configured to move between an unlock position illustrated in FIG. 4(B) and a lock position illustrated in FIG. 4(A). When an external force is not applied to the lock lever 145, the lock lever 145 is urged toward the lock position by the coil spring 148. An contact end 146 is formed at an end of the lock lever 145. When the contact end 146 of the lock mechanism 144 contacts the end portion 45 of the ink cartridge 30, the ink cartridge 30 is locked (fixed) to the cartridge holder 110 in the mount position. When the lock lever 145 is in the unlock position, the contact end 146 is above positioned the upper wall 39 of the ink cartridge 30. When the lock lever 145 is in the lock position, the contact end 146 is in contact with the upper wall 39.

An optical detector 141 is positioned adjacent to the lock mechanism 144. The optical detector 141, which has the same structure as those of the optical detectors 114 and 126 described above, has a detection area 142. A detection target portion 147 is positioned on a side of the lock lever 145 opposite the contact end 146 side. The optical detector 141 is positioned, such that the detection area 142 is positioned in the range of rotational movement of the detection target portion 147. Therefore, the detection target portion 147 can enter the detection area 142 depending on the position of the lock lever 145. In this embodiment, when the lock lever 145 is in the lock position, the detection target portion 147 is positioned in the detection area 142. When the lock lever 145 is in the unlock position, the detection target portion 147 is positioned outside the detection area 142. Whether or not the lock lever 145 is in the lock position can be determined based on an output signal of the optical detector 141, corresponding to the intensity of light received by the optical detector 141, when the detection target portion 147 enters the detection area 142 or moves away from the detection area 142.

Figure 5A:
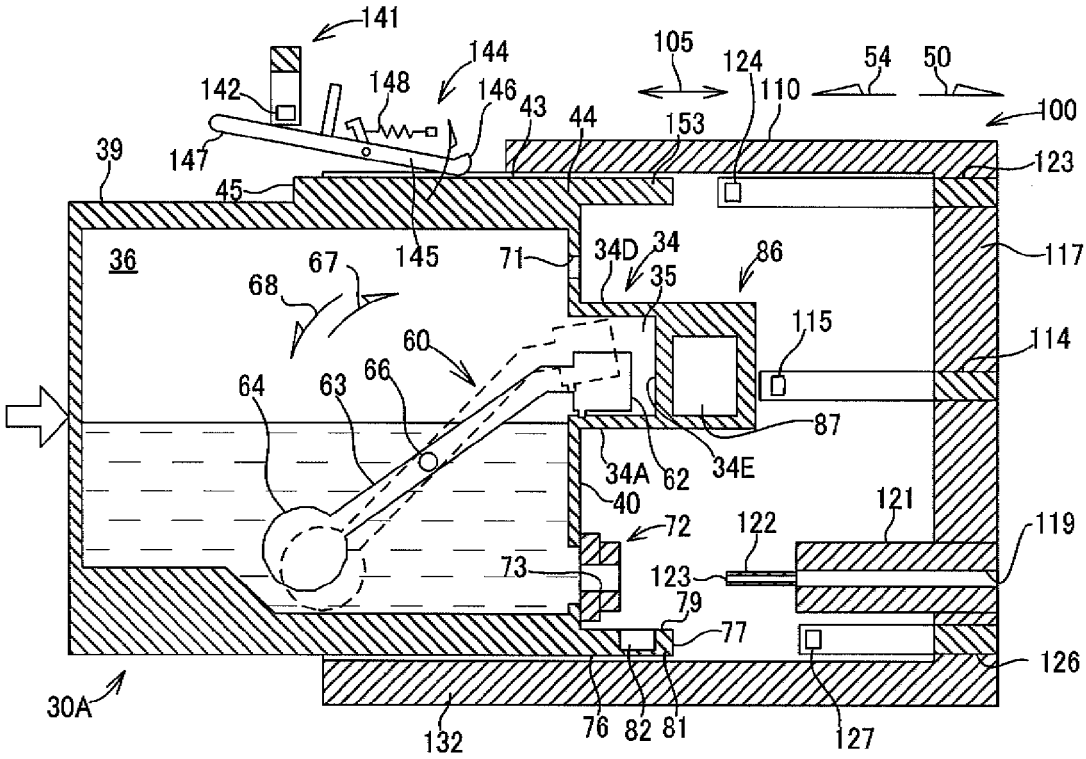
FIG. 5(A) is a vertical cross-sectional view of the ink cartridge of FIGS. 2(A) and 2(B) and the cartridge holder of FIGS. 4(A) and 4(B), in which the ink cartridge is inserted into the cartridge holder.

Referring to FIG. 5(A), when the ink cartridge 30A is inserted into the cartridge holder 110 in the insertion direction 50, the end of the protrusion 153 contacts the contact end 146 of the lock lever 145. When the ink cartridge 30A is further inserted into the cartridge holder 110, the lock lever 145 pivots counterclockwise by the contact end 146 being pushed up, and the lock lever 145 pivots from the lock position (see FIG. 4(A)) to the unlock position (see FIG. 4(B)). The contact end 146, which has been pushed up, is positioned on the upper surface of the rib 43.

Before the ink cartridge 30A is inserted, the lock lever 145 is in the lock position (see FIG. 4(A)), and the detection target portion 147 of the lock lever 145 blocks light in the detection area 142. Therefore, the output signal of the optical detector 141 is a LOW level signal (see FIG. 7(A)). When the ink cartridge 30A is inserted and the lock lever 145 pivots to the unlock position (see FIG. 4(B)) as described above, the detection target portion 147 moves away from the detection area 142 while the lock lever 145 pivots. Therefore, the output signal of the optical detector 141 changes from the LOW level signal to a HI level signal (at TO in FIG. 7(A)).

Figure 5B:
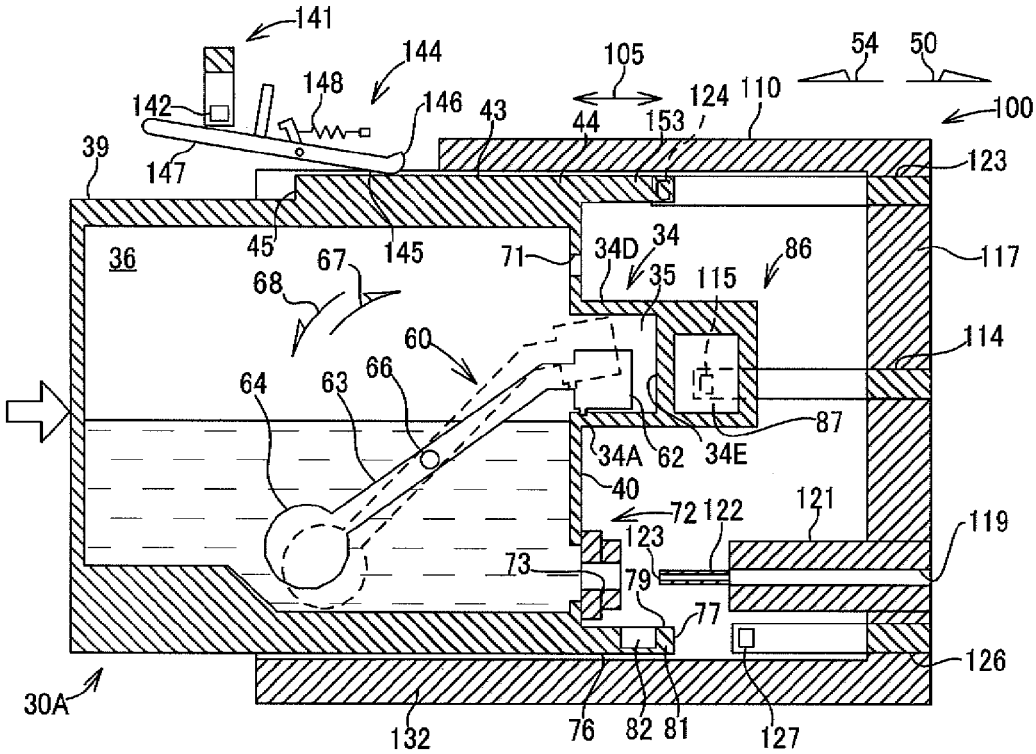
FIG. 5(B) is a vertical cross-sectional view of the ink cartridge and the cartridge holder, in which the ink cartridge is further inserted into the cartridge holder from the state shown in FIG. 5(A).

Referring to FIG. 5(B), when the ink cartridge 30A is further inserted, the determination portion 86 enters the detection area 115 of the optical detector 114. A When this occurs, the output signal of the optical detector 114 changes from a HI level signal to a LOW level signal (at T1 in FIG. 7(A)), and then the window 87 enters the detection area 115, such that the output signal of the optical detector 114 returns to the HI level signal from the LOW level signal (between T1 and T2 in FIG. 7(A)).

Subsequently, the protrusion 153 enters the detection area 124 of the optical detector 123. When this occurs, the output signal of the optical detector 123 changes from a HI level signal to a LOW level signal (at T2 in FIG. 7(A)). In this embodiment, the position of the ink cartridge 30A when the protrusion 153 enters the detection area 127 of the optical detector 123 at T2 corresponds to a predetermined position of the present invention. In this embodiment, this change in the output signal of the optical detector 123 from the HI level signal to the LOW level signal corresponds to a reference signal of the present invention.

Figure 6A:
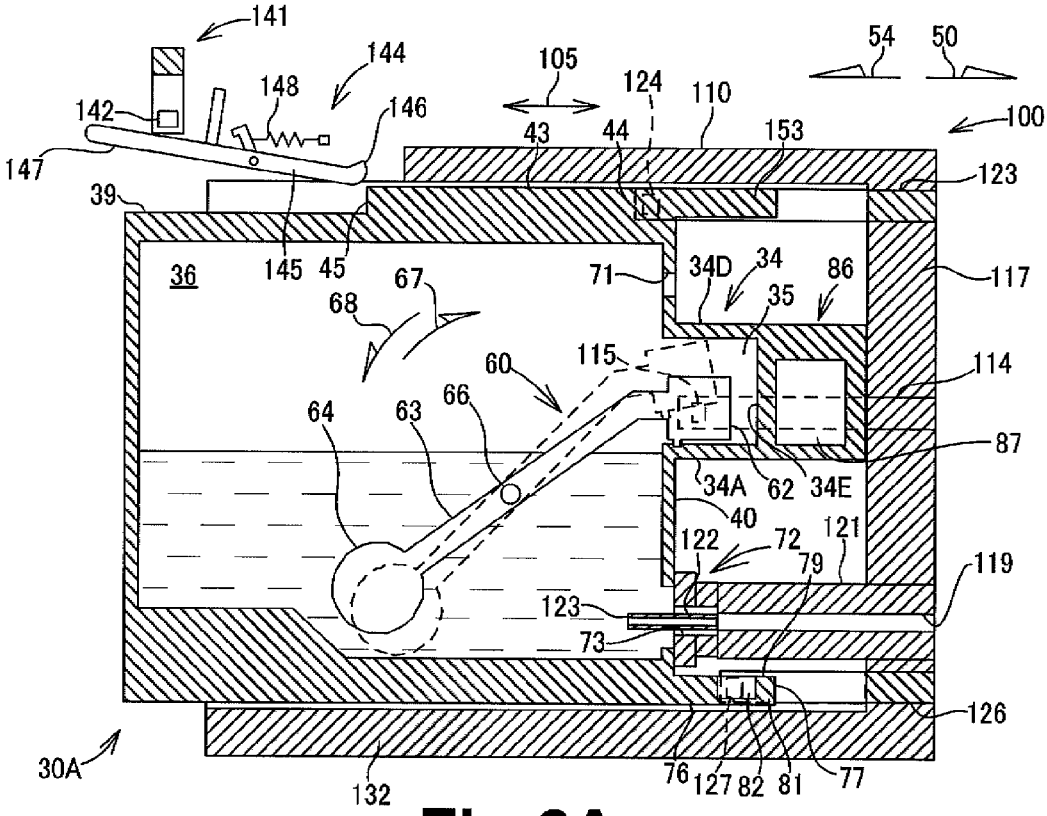
FIG. 6(A) is a vertical cross-sectional view of the ink cartridge and the cartridge holder, in which the ink cartridge is in a mount position and the lock lever is in the unlock position.
Figure 6B:
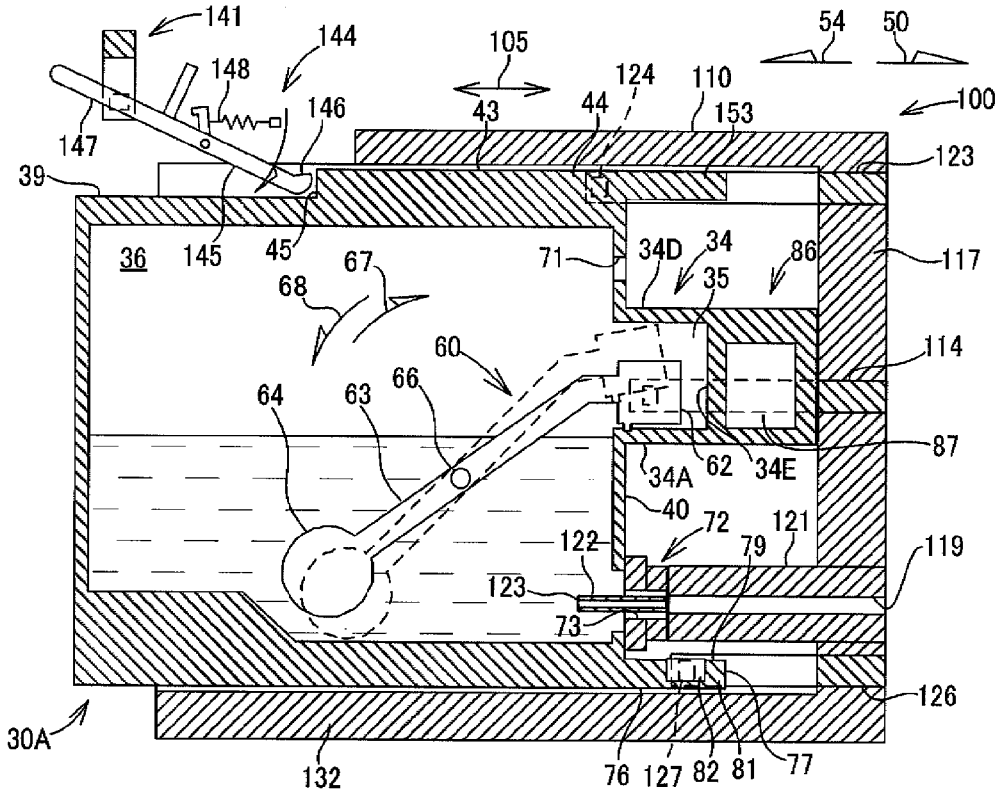
FIG. 6(B) is a vertical cross-sectional view of the ink cartridge and the cartridge holder, in which the ink cartridge is in the mount position and the lock lever is in the lock position.

Referring to FIG. 6(A), when the ink cartridge 30A is further inserted and the ink cartridge 30A reaches the mount position, the front wall 34E of the detection portion 34 passes the detection area 115 of the optical detector 114, and then the irradiation portion 34C of the detection portion 34 is positioned in the detection area 115 of the optical detector 114. During the passage of the front wall 34E through the detection area 115, the output signal of the optical detector 114 changes from the LOW level signal to the HI level signal, and then from the HI level signal to the LOW level signal (see FIG. 7(A)). The mount position is the position at which ink can be supplied from the ink cartridge 30A to the ink supply tube 122. In this embodiment, the mount position is the position in which the ink supply portion 72 contacts the connection portion 121 and the ink supply tube 122 is inserted into the through hole 73.

Figure 7A:
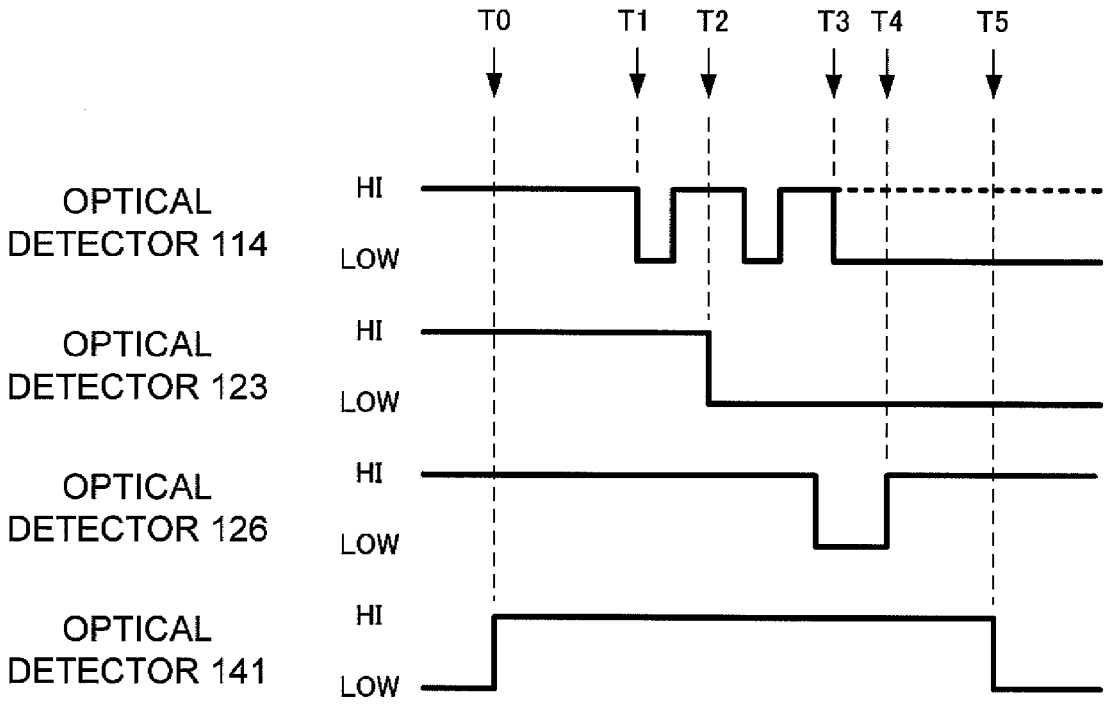
FIG. 7(A) is time profiles of output signals from four optical detectors during insertion of the ink cartridge of FIGS. 2(A) and 2(B) into the cartridge holder of FIGS. 4(A) and 4(B)
Figure 7B:
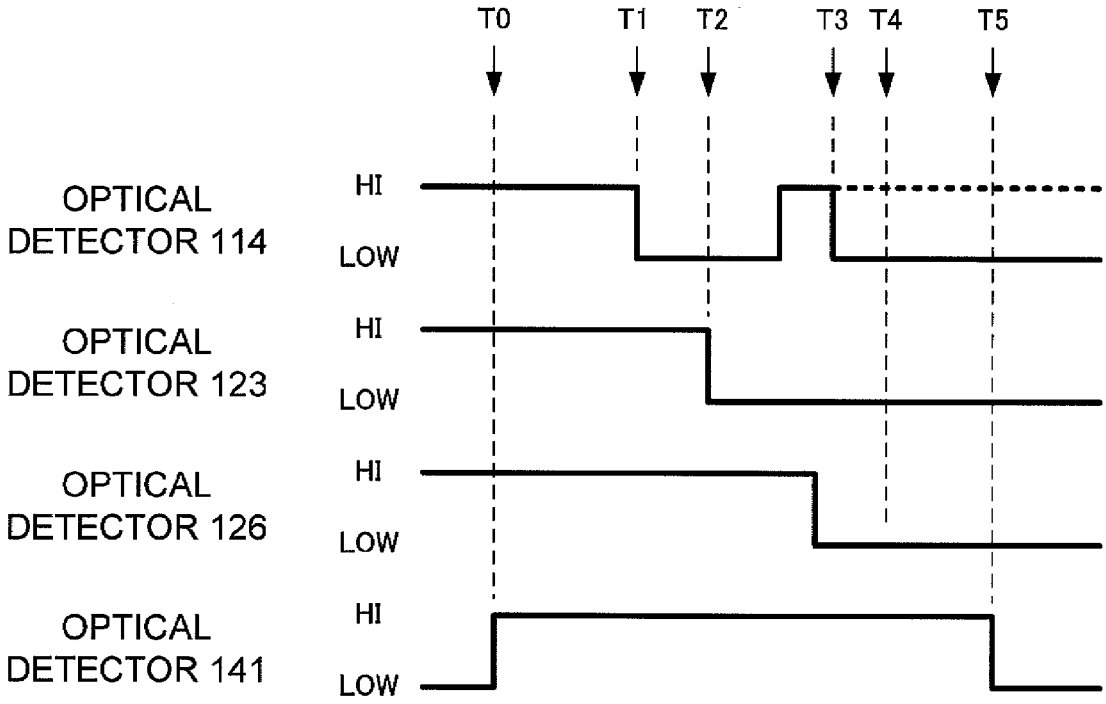
FIG. 7(B) is time profiles of output signals from four optical detectors during insertion of the ink cartridge of FIGS. 3(A) and 3(B) into the cartridge holder of FIGS. 4(A) and 4(B).

In a state in which the irradiation portion 34C is positioned in the detection area 115, if the amount of ink stored in the ink chamber 36 is greater than or equal to the predetermined amount, that is, if the light-blocking plate 62 is in the lower position (see the solid line in FIG. 6), the light-blocking plate 62 blocks light in the detection area 115. In this case, as illustrated in FIG. 7(A), the output signal of the optical detector 114 has changed from the HI level signal to the LOW level signal (at T3 in FIG. 7(A)). On the other hand, if the amount of ink stored in the ink chamber 36 is less than the predetermined amount, that is, if the light-blocking plate 62 is in the upper position (see the broken line in FIG. 6), the light-blocking plate 62 does not block light in the detection area 115. In this case, the output signal remains as the HI level signal (see the broken line in FIG. 7(A)).

When the ink cartridge 30A reaches the mount position, the light-blocking portion 81 positioned at the rib 79 has passed the detection area 127 of the optical detector 126, and the cutout 82 is positioned in the detection area 127. During the passage of the light-blocking portion 81 through the detection area 127, the output signal of the optical detector 126 temporarily changes from the HI level signal to the LOW level signal, and then from the LOW level signal to the HI level signal (see FIG. 7(A)). When the cutout 82 is positioned in the detection area 127, the output signal remains as the HI level signal because the light is not blocked in the detection area 127.

When the ink cartridge 30A reaches the mount position, the end portion 45 of the rib 43 has passed the contact end 146 of the lock lever 145. When this occurs, the contact end 146 is not supported by the upper wall of the rib 43. Therefore, the lock lever 145 that has been pushed up pivots downward, and the contact end 146 contacts the upper surface of the upper wall 39 of the ink cartridge 30 and the end portion 45. Thus, the contact end 146 contacts the end portion 45, whereby the movement of the ink cartridge 30A in the removal direction 54 becomes prevented. At this time, the detection target portion 147 of the lock lever 145 blocks light in the detection area 142. Thus, the output signal of the optical detector 141 changes from the HI level signal to the LOW level signal (at T5 in FIG. 7(A)). In this embodiment, this change in the output signal of the optical detector 141 from the HI level signal to the LOW level signal corresponding to a mount completion signal of the present invention.

Next, how the ink cartridge 30B is inserted into the cartridge holder 110 will be described. Description of how the ink cartridge 30B is inserted into the cartridge holder 110, which is the same as the description of how the ink cartridge 30A is inserted into the cartridge holder 110 will be omitted. During the insertion of the ink cartridge 30B into the cartridge holder 110, the determination portion 89 enters the detection area 115 of the optical detector 114. When this occurs, the output signal of the optical detector 114 changes from the HI level signal to the LOW level signal (at T1 in FIG. 7(B)). Because the determination portion 89 does not have the window 87 as described above, the output signal of the optical detector 114 remains as the LOW level signal (see FIG. 7(B)) until the ink amount detection portion 34 enters the detection area 115. That is, at time T2 at which the optical detector 123 initially detects the protrusion 153, the output signal of the optical detector 114 is the LOW level signal.

During the insertion of the ink cartridge 30B, the rib 84 of the protruding member 76 enters the detection area 127 of the optical detector 126. Thus, the rib 84 blocks light in the detection area 127. At this time, the output signal of the optical detector 126 changes from the HI level signal to the LOW level signal (see FIG. 7(B)). Because the rib 84 does not have the cutout 82 as described above, even after the ink cartridge 30B has reached the mount position, the rib 84 continues to block light in the detection area 127 (see FIG. 7(B)). Therefore, at time T5 at which the output signal of the optical detector 141 changes from the HI level signal to the LOW level signal, the output signal of the optical detector 126 is the LOW level signal.

Figure 8:
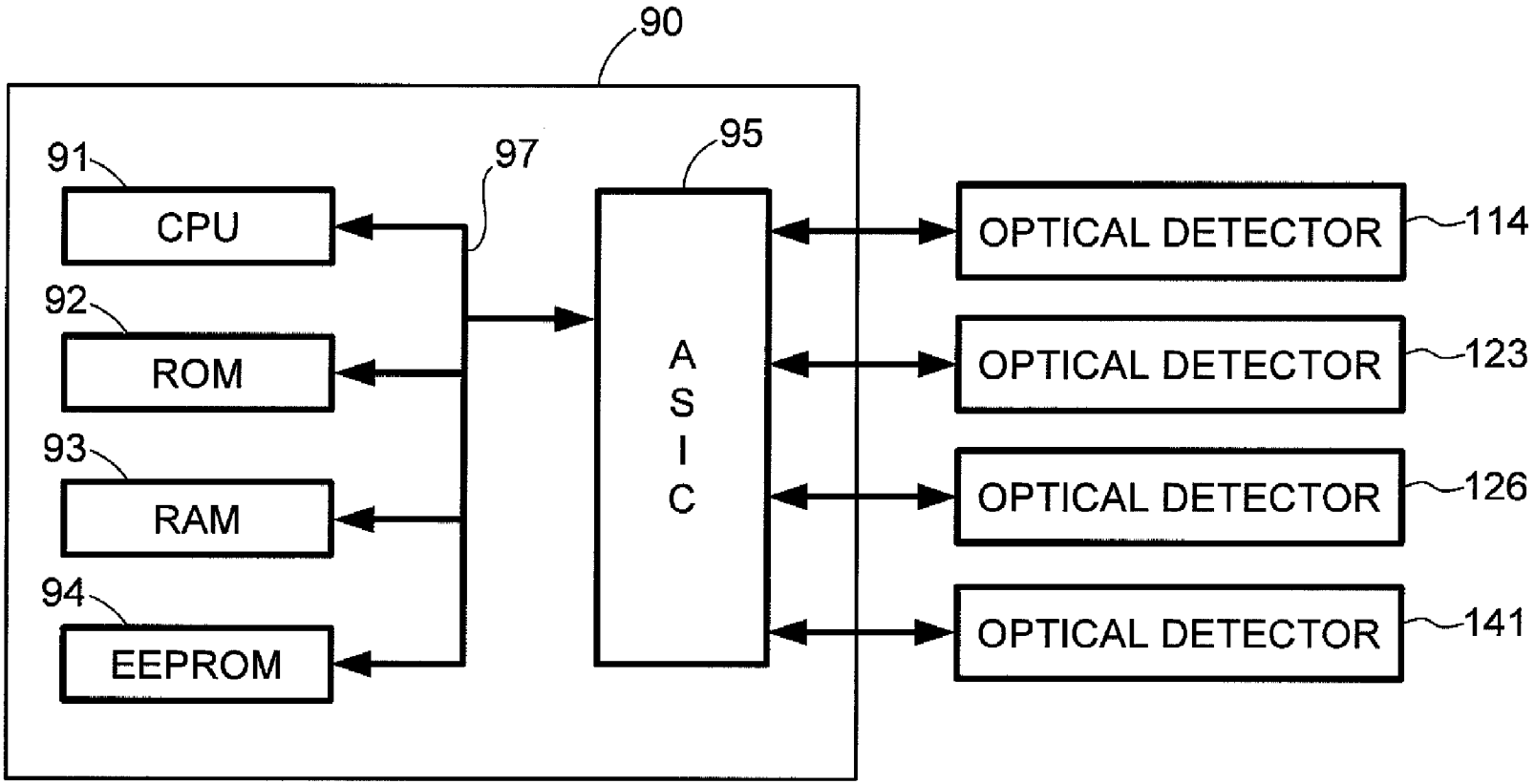
FIG. 8 is a block diagram of a configuration of a controller according to an embodiment of the present invention.

Referring to FIG. 8, the controller 90 is configured to control the overall operation of the printer 10. The controller 90 is a microcomputer comprising a CPU 91, a ROM 92, a RAM 93, an EEPROM 94, and an ASIC 95.

The ROM 92 is configured to store programs executed by the CPU 91 such as a program for controlling various operations of the printer 10 and a program for performing a determination process described below. The RAM 93 is configured to serve as a storage area for temporarily recording data and a signal that are used when the CPU 91 executes the programs and as a work area for data processing. The EEPROM 94 stores flags and the like that are to be stored after power off. For example, the EEPROM 94 stores data (look-up data) that represents the correspondence between the signal level (HI or LOW) of the optical detector 114 and the initial amount of ink, e.g., standard type or large-volume type, and the correspondence between the signal level (HI or LOW) of the optical detector 126 and the coloring agent of the ink, e.g., the pigment ink or dye ink. This data is used for determination performed in steps S4, S5, S8, and S9 described below.

The ASIC 95 is electrically connected to the optical detectors 114, 123, 126, and 141. Although not illustrated in FIG. 8, the ASIC 95 is also electrically connected to a driving circuit for driving rollers such as the sheet feed roller 23 and the pair of transport rollers 25 (see FIG. 1), an input section for inputting an image recording command to the printer 10, and a display for displaying information related to the printer 10.

Each of the optical detectors 114, 123, 126, and 141 outputs an analog electric signal (a voltage signal or a current signal) in accordance with the intensity of light received by the light receiver. The output signal is input to the controller 90. The controller 90 determines that the output signal is the HI level signal if the electrical level (the voltage or the current) is greater than or equal to a predetermined threshold value, and determines that the output signal is the LOW level signal if the electric level of the output signal is less than the predetermined threshold value. In this embodiment, the output signal is determined to be the LOW level signal when light in the detection areas 115, 124, 127, and 142 of the optical detectors is blocked and determined to be the HI level signal when the light is not blocked.

Figure 9:
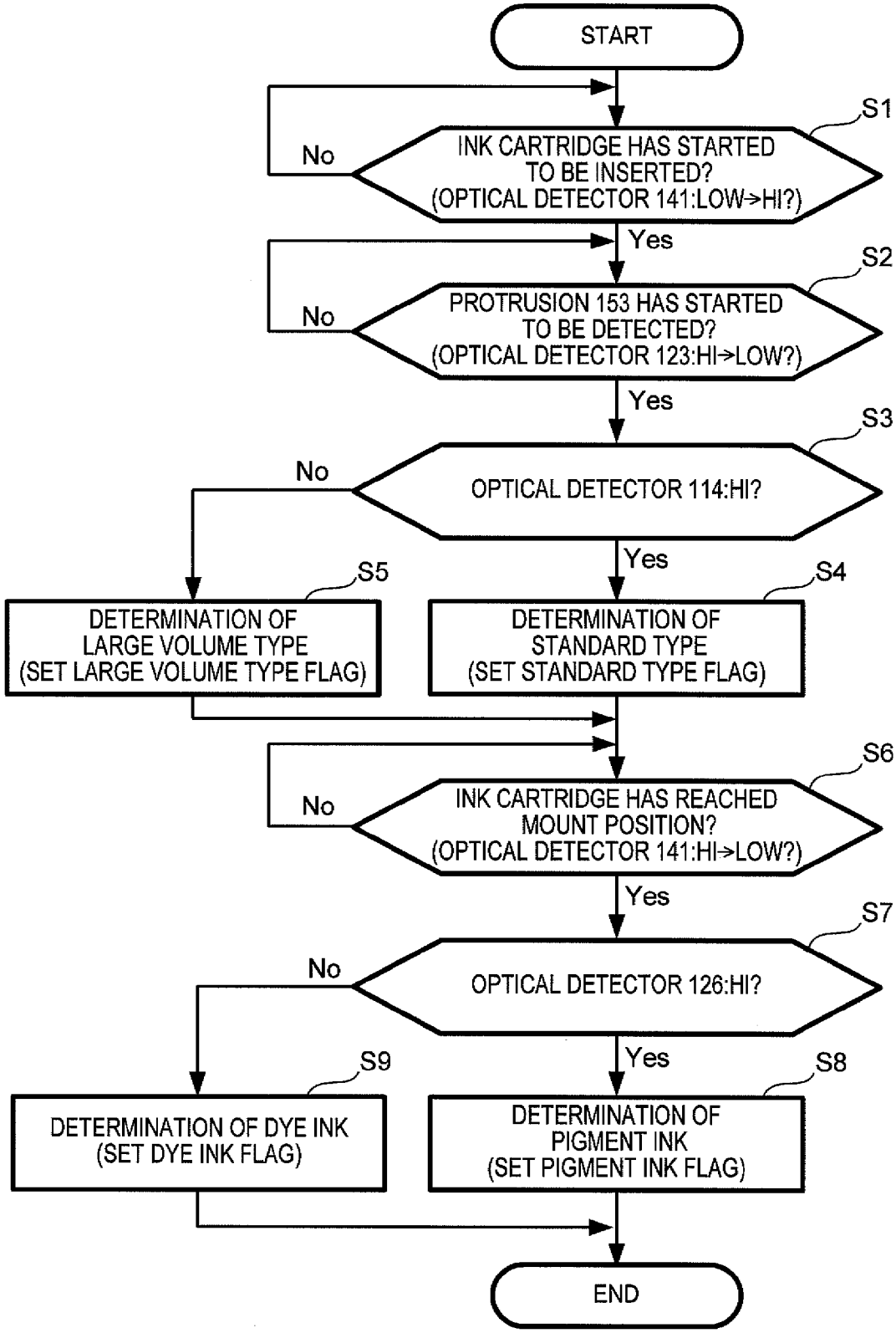
FIG. 9 is a flowchart of processes performed by the controller.

Referring to FIG. 9, the controller 90, as a first determiner and a second determiner, is configured to perform determination of the characteristics of the ink cartridge 30 inserted into and mounted onto the cartridge holder 110 based on the output signals of the optical detectors 114, 123, 126, and 141.

In step S1, the CPU 91 determines whether the ink cartridge 30 has started to be inserted into the cartridge holder 110. As described above, when the ink cartridge 30 is inserted into the cartridge holder 110, the position of the lock lever 145 changes from the lock position to the unlock position, and the output signal of the optical detector 141 changes from the LOW level signal to the HI level signal (at TO in FIG. 7). Therefore, in step S1, if the output signal of the optical detector 141 changes from the LOW level signal to the HI level signal, it is determined that the ink cartridge 30 has started to be inserted into the cartridge holder 110.

If it is determined that the ink cartridge 30 has started to be inserted into the cartridge holder 110 in step S1 ("Yes" in S1), in the next step S2, the CPU 91 determines whether the protrusion 153 has started to be detected. More specifically, if the output signal of the optical detector 123 changes from the HI level signal to the LOW level signal, i.e., if the reference signal is output, the CPU 91 determines that the protrusion 153 has started to be detected.

If it is determined that protrusion 153 has started to be detected, the CPU 90 determines whether or not the output signal of the optical detector 114 is the HI level signal at the time (T2 in FIG. 7) at which the protrusion 153 is initially detected (S3). This determination corresponds to the determination as to whether the ink cartridge 30 has the determination portion 86 or the determination portion 89. If it is determined that the output signal of the optical detector 114 is the HI level signal ("Yes" in S3), the CPU 90 determines that the ink cartridge 30 has the determination portion 86, i.e., the ink cartridge 30 is the standard type ink cartridge 30A, and a flag (determination result) representing the standard type is stored in the register of the CPU 91, in the RAM 93, or the like (S4). On the other hand, if it is determined that the output signal of the optical detector 114 is the LOW level signal ("No" in S3), the CPU 90 determines that the ink cartridge 30 has the determination portion 89, i.e., the ink cartridge 30 is the large volume type ink cartridge 30B, and a flag (determination result) representing the large volume is stored in the register of the CPU 91, in the RAM 93, or the like (S5).

Subsequently, in step S6, whether the ink cartridge 30 has reached the mount position and fixed (locked) in the mount position is determined. More specifically, if the output signal of the optical detector 141 changes from the HI level signal to the LOW level signal, it is determined that the ink cartridge 30 has reached the mount position.

If it is determined that the ink cartridge 30 has reached the mount position ("Yes" in S6), the CPU 90 determines whether or not the output signal of the optical detector 126 is the HI level signal at the time (T5 in FIG. 7) at which the ink cartridge 30 reaches the mount position (S7). This determination corresponds to the determination as to whether the ink cartridge 30 has the rib 79 or the rib 84. If the output signal of the optical detector 126 is the HI level signal ("Yes" in S7), the CPU 90 determines that the ink cartridge 30 has the rib 79, i.e., the CPU 90 determines that the ink cartridge 30 stores the pigment ink, and a flag (determination result) representing the pigment ink is stored in the register of the CPU 91, in the RAM 93, or the like (S8). On the other hand, if the output signal of the optical detector 126 is the LOW level signal ("No" in S7), the CPU 90 determines that the ink cartridge 30 has the rib 84, i.e., the CPU 90 determines that the ink cartridge 30 stores the dye ink, and a flag (determination result) representing the dye ink is stored in the register of the CPU 91, the RAM 93, or the like (S9).

Thus, in the embodiment described above, during the insertion of the ink cartridge 30 into the cartridge holder 110, the first characteristic of the ink cartridge 30, i.e., the initial amount of ink stored in the ink cartridge 30 (standard type or large-volume type) is determined based on the output signal of the optical detector 114 at a time at which the protrusion 153 is initially detected by the optical detector 123 (at T2 in FIG. 7). The second characteristic of the ink cartridge 30, i.e., the coloring agent of ink (pigment ink or dye ink) is determined based on the output signal of the optical detector 126 when the ink cartridge 30 reaches the mount position (at T5 in FIG. 7). As a result, the determination of the first characteristic at time T2 and the determination of the second characteristic time T5 are accurately performed.

In the embodiment described above, determination in step S7 is triggered at the time at which the ink cartridge 30 is fixed (locked) in the mount position by the lock mechanism 144 (at the time at which the output signal of the optical detector 141 changes form the HI level signal to the LOW level signal (time T5)). In another embodiment, the determination in step S7 may be triggered, for example, at a time that is a predetermined time Δt after the time T5. Alternatively, the determination in step S7 may be preformed at a time at which a trigger signal input from the outside (an external signal) is received after the ink cartridge 30 has been mounted in the mount position. As a further alternative, a detector for detecting opening/closing movement of the cover 19 (see FIG. 1) may be provided, and the determination in step S7 may be performed at a time at which the opening 112 is covered with the cover 19.

The determination portions 86 and 89 and the ribs 79 and 84 block light. However, it is not necessary that these members completely block light emitted from the light emitter toward the light receiver in the optical detectors 114 and 126. For example, these members may make the intensity of light received by the light receiver less than the predetermined value by blocking or attenuating light emitted by the light emitter by altering the direction of the light by reflecting or diffracting all or a part of the light or by attenuating the light using ground glass or an aperture.

In the embodiment described above, for convenience of description, it is assumed that the ink cartridge 30A stores a standard initial amount of pigment ink and the ink cartridge 30B stores a larger initial amount of dye ink. However, the present invention is not limited to determination of these characteristics of the ink cartridge 30. For example, by assigning the determination portion 86 having the window 87 to cyan ink, the determination portion 89 not having the window 87 to magenta ink, the rib 79 having the cutout 82 to yellow ink, and the rib 84 not having the cutout 82 to black ink, it is possible to determine the color of ink stored in the ink cartridge 30. In this case, the color of ink is determined based on data (look-up data) representing the correspondence between the signal levels of the optical detectors and the colors of ink.

In another embodiment, the characteristic of the ink cartridges 30 may relate to the place of manufacture of the ink. When the place of manufacture is determined, such information is stored in the controller 90. If a quality problem occurs in the printer 10, and the printer 10 is returned to the manufacturer, the manufacturer can know the place of manufacture of the ink used in the returned printer 10 based on the information stored in the controller 90. Accordingly, studies of the quality problem may become easier.

In another embodiment, the characteristic of the ink cartridges 30 may relate to the date of manufacture of the ink. When the date of manufacture is determined, such information is stored in the controller 90. If a quality problem occurs in the printer 10, and the printer 10 is returned to the manufacturer, the manufacturer can know the date of manufacture of the ink used in the returned printer 10 based on the information stored in the controller 90.

In another embodiment, the characteristic of the ink cartridges 30 may relate to ink cartridge 30 for general user's use and ink cartridge 30 for maintenance operator's use. The maintenance operator is a person who is able to repair the printer 10 at the site of use. The maintenance operator may perform a special operation for repairing the printer 10. For example, when the ink cartridge 30 for the maintenance operator's use is mounted to the printer 12, special operations which cannot be performed by the general users such as a purge operation discharging a large amount of ink are authorized by the controller 90.

In another embodiment, the type of the ink cartridge may relate to air solubility of ink. If the ink has a low air-solubility, the ink chamber 36 may not be depressurized. In contrast, if the ink has a high air-solubility, the ink chamber 36 may be depressurized. A program for maintaining the recording head 21 is changed based on the determination of the type relating to air solubility of ink.

Figure 10A:
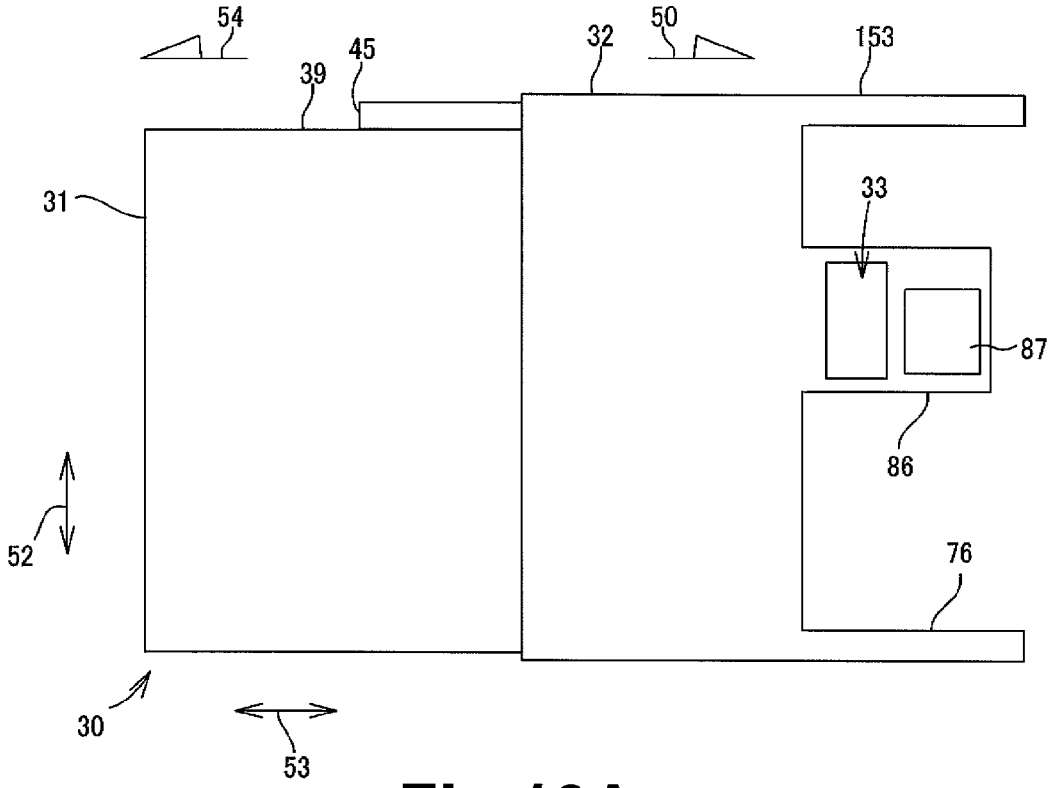
FIG. 10(A) is a perspective view of an ink cartridge according to a modified embodiment of the present invention.
Figure 10B:
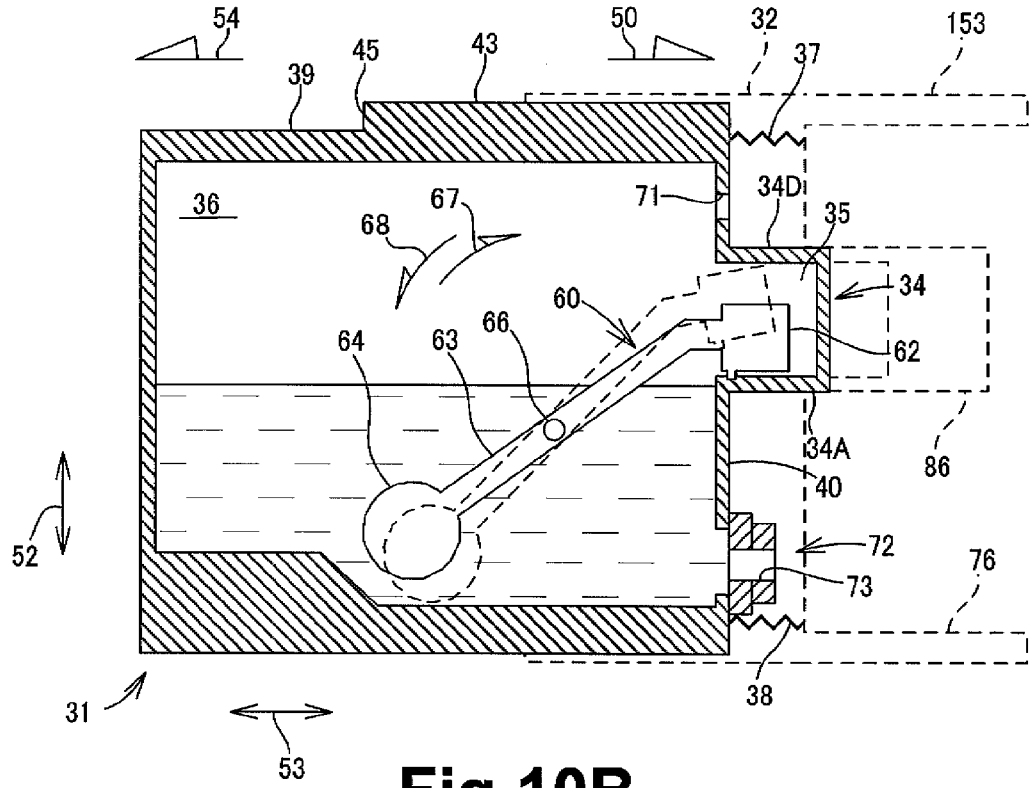
FIG. 10(B) is a vertical cross-sectional view of the ink cartridge.

Referring to FIGS. 10(A) and 10(B), the ink cartridge 30 according to a modified embodiment, comprises a cartridge body 31, which comprises the ink chamber 36 formed therein, and a cover 32 that covers the front side of the cartridge body 31 in the insertion direction 50.

Except that the cartridge body 31 does not comprise the protruding member 76, the protrusion 153, and the determination portion 86 (or the determination portion 89), the structure of the cartridge body 31 is the same as that of the ink cartridge 30 described above. Therefore, the cartridge body 31 has a substantially rectangular-parallelepiped shape that is narrow in the width direction 51, and the cartridge body 31 comprises the ink chamber 36 formed therein. At the front wall 40 of the cartridge body 31 in the insertion direction 50, the ink amount detection portion 34, the air communication opening 71, and the ink supply portion 72 are provided. Such components are the same as those of the embodiment described above, and detailed description of such components will be omitted.

The cover 32 is a hollow box-shaped member that covers the front side of the cartridge body 31 in the insertion direction 50. The cover 32 is slid able along outer walls of the cartridge body 31 with respect to the insertion direction 50. Although not illustrated in the drawings, the cover 32 is configured to engage the cartridge body 31 at a position that is separated from the cartridge body 31 by a predetermined distance in the insertion direction 50, so that the sliding range of the cover 32 in the insertion direction 50 is limited. Coil spring 37 and 38 are positioned between the front wall 40 of the cartridge body 31 and the cover 32. The coil springs 37 and 38 urge the cover 32 in a direction away from the front wall 40 of the cartridge body 31, i.e., in the insertion direction 50.

At the front side of the cover 32 in the insertion direction 50, the protruding member 76, the protrusion 153, and the determination portion 86 (or the determination portion 89), which are similar to those described above, are provided. Detailed description of these members is omitted, because they are similar to those in the embodiment described above. A window 33 is formed through the determination portion 86 (or the determination portion 89) in the width direction 51 at the rear of the window 87 of the determination portion (or a rear portion of the determination portion 89) in the insertion direction 50. When the cartridge body 31 is moved to a position closest to the cover 32, the ink amount detection portion 34 enters an area that corresponds to the window 33, such that the ink amount detection portion 34 is exposed to the outside of the cover 32 in the width direction 51. When the cover 32 is separated from the cartridge body 31, the ink amount detection portion 34 moves away from the area that corresponds to the window 33, such that the ink amount detection portion 34 is covered in the cover 32. The window 33 allows light of the optical detector 114 to pass there through.

Although not illustrated in the drawings, a through hole into which the connection portion 121 and the ink supply tube 122 can be inserted are formed through the front side of the cover 32 in the insertion direction 50 at a position that corresponds to the ink supply portion 72. The connection portion 121 and the ink supply tube 122 are connected to the ink supply portion 72 through the through hole.

As with the embodiment described above, during the insertion of the ink cartridge 30 into the cartridge holder 110, the protrusion 153 enters the detection area 124 of the optical detector 123, and the determination of the characteristic of the ink cartridge 30 is performed based on the signal levels of the optical detector 114 at the time at which the protrusion 153 initially blocks the light in the detection area 124. When the ink cartridge 30 is inserted further, the front side of the cover 32 in the insertion direction 50 contacts the end wall 117 of the cartridge holder 110. When the cartridge body 31 is pushed in the insertion direction 50 against the urging forces of the coil spring 37 and 38, the cartridge body 31 is moved to a position closest to the cover 32, the ink cartridge 30 reaches the mount position in the cartridge holder 110, and the irradiation portion 34C of the ink amount detection portion 34 enters the detection area 115 of the optical detector 114. When the ink cartridge 30 is fixed (locked) in the mount position by the lock mechanism 144, the characteristic of the ink cartridge 30 is determined based on the signal levels of the optical detector 126 at this time.

Because the cover 32 is provided, if the ink cartridge 30 is dropped or collides with another member, the cover 32 protects the front side of the cartridge body 31 in the insertion direction 50. That is, the ink supply portion 72 and the ink amount detection portion 34 are prevented from being damaged. The controller 90 can perform the determination process of determining the characteristics of the ink cartridge 30 that comprises the cover 32.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink supply device comprising:

a cartridge mounting portion to which an ink cartridge is configured to be mounted by being inserted thereinto in an insertion direction;

a first optical detector comprising a first light emitter configured to emit light and a first light receiver configured to receive light emitted by the first light emitter;

a second optical detector comprising a second light emitter configured to emit light and a second light receiver configured to receive light emitted by the second light emitter, wherein the second optical detector is different from the first optical detector;

a first output unit configured to output a reference signal when the ink cartridge reaches a predetermined position in the cartridge mounting portion, wherein the first output unit is different from each of the first optical detector and the second optical detector;

a first detection target portion positioned on the ink cartridge, wherein the first detection target portion is configured to be positioned in a first optical path when the ink cartridge reaches the predetermined position, the first optical path extending from the first light emitter to the first light receiver;

a first determiner configured to determine a first characteristic of the ink cartridge inserted into the cartridge mounting portion based on whether or not an intensity of light received by the first light receiver is greater than or equal to a predetermined value when the first output unit outputs the reference signal;

a second output unit configured to output a mount completion signal when the ink cartridge reaches a mount position which is offset from the predetermined position in the insertion direction in the cartridge mounting portion, wherein the mount completion signal indicates that the ink cartridge has been completely mounted to the cartridge mounting portion, wherein the second output unit is different from each of the first optical detector, the second optical detector, and the first output unit;

a second detection target portion positioned on the ink cartridge, wherein the second detection target portion is configured to be positioned in a second optical path when the ink cartridge reaches the mount position, the second optical path extending from the second light emitter to the second light receiver; and a second determiner configured to determine a second characteristic of the ink cartridge inserted into the cartridge mounting portion based on whether or not an intensity of light received by the second light receiver is greater than or equal to a predetermined value when the second output unit outputs the mount completion signal.

2. The ink supply device according to claim 1, wherein the ink cartridge comprises a front wall surface facing forward in the insertion direction during an insertion of the ink cartridge into the cartridge mounting portion, and an ink amount detection portion positioned at the first wall surface, wherein the ink amount detection portion is configured to be positioned in the first optical path when the ink cartridge reaches the mount position, and wherein the first detection target portion is positioned in front of the ink amount detection portion in the insertion direction.

3. The ink supply device according to claim 1, wherein the ink cartridge comprises:

a front wall surface facing forward in the insertion direction during an insertion of the ink cartridge into the cartridge mounting portion;

a movable member configured to move away from the front wall surface in the insertion direction and move toward the front wall surface in a direction opposite to the insertion direction, wherein the movable member comprises the first detection target portion; and a resilient member configured to resiliently urge the movable member in the insertion direction away from the first wall surface.

4. The ink supply device according to claim 1, wherein the first detection target portion has a shape corresponding to the first characteristic of the ink cartridge, such that the first detection target portion enters the first optical path, causing the intensity of light received by the first light receiver to become either less than the predetermined value, or greater than or equal to the predetermined value.

5. The ink supply device according to claim 4, wherein the first detection target portion of a first ink cartridge is configured to block light in the first optical path when the ink cartridge reaches the predetermined position, and the first detection target portion of a second ink cartridge comprises a light passing member configured to allow light to pass therethrough along the first optical path when the ink cartridge reaches the predetermined position.

6. The ink supply device according to claim 1, wherein the ink cartridge comprises:

a front wall surface facing forward in the insertion direction during an insertion of the ink cartridge into the cartridge mounting portion;

an ink supply portion positioned at the first wall surface and configured to supply ink from an interior of the ink cartridge to an exterior of the ink cartridge, and a first protrusion protruding from the font wall surface in the insertion direction further than the ink supply portion, wherein the first protrusion comprises the second detection target portion.

7. The ink supply device according to claim 6, wherein the ink cartridge comprises a second protrusion protruding from the front wall surface in the insertion direction than the ink supply portion, wherein the ink supply portion is positioned between the first protrusion and the second protrusion.

8. The ink supply device according to claim 1, wherein the second detection target portion has a shape corresponding to the second characteristic of the ink cartridge, such that the second detection target portion enters the second optical path, causing the intensity of light received by the second light receiver to become either less than the predetermined value, or greater than or equal to the predetermined value.

9. The ink supply device according to claim 8, wherein the second detection target portion of a third ink cartridge is configured to block light in the second optical path when the ink cartridge reaches the mount position, and the second detection target portion of a fourth ink cartridge comprises a light passing member configured to allow light to pass therethrough along the second optical path when the ink cartridge reaches the mount position.

10. The ink supply device according to claim 1, wherein the first output unit comprises a third detector configured to detect that the ink cartridge reaches the predetermined position, and to output the reference signal when the third detector detects that the ink cartridge reaches the predetermined position.

11. The ink supply device according to claim 1, wherein the cartridge mounting portion comprises a retainer configured to move between a first position and a second position, wherein when the retainer is in the first position the retainer contacts an outer surface of the ink cartridge so as to retain the ink cartridge in the mount position, and when the retainer is in the second position the retainer is separated from the outer surface of the ink cartridge, and wherein the second output unit comprises a fourth detector configured to detect that the retainer moves from the second position to the first position, and to output the mount completion signal when the fourth detector detects that the retainer moves from the second position to the first position.

12. The ink supply device according to claim 1, wherein the first optical detector is configured to output a first signal, wherein a level of the first signal changes in accordance with the intensity of light received by the first light receiver, wherein the first signal is different from each of the reference signal and the mount complete signal, wherein the second optical detector is configured to output a second signal, wherein a level of the second signal changes in accordance with the intensity of light received by the second light receiver, and wherein the second signal is different from each of the reference signal, the mount complete signal, and the first signal.

13. The ink supply device according to claim 12, wherein the first determiner is configured to determine the first characteristic of the ink cartridge inserted into the cartridge mounting portion based on the level of the first signal when the first output unit outputs the reference signal, wherein the second determiner is configured to determine the second characteristic of the ink cartridge inserted into the cartridge mounting portion based on the level of the second signal when the second output unit outputs the mount completion signal.

* * * * *